US007884710B2

(12) United States Patent
Godiska et al.

(10) Patent No.: US 7,884,710 B2
(45) Date of Patent: Feb. 8, 2011

(54) AUDIO MODULATION FOR A CHILD MOTION DEVICE

(75) Inventors: James E. Godiska, Exton, PA (US); William B. Bellows, Wyomissing, PA (US); John (Jason) C. Arnold, IV, Philadelphia, PA (US)

(73) Assignee: Graco Children's Product Inc., Exton, PA (US)

( * ) Notice: Subject to any disclaimer, the term of this patent is extended or adjusted under 35 U.S.C. 154(b) by 333 days.

(21) Appl. No.: 11/933,225

(22) Filed: Oct. 31, 2007

(65) Prior Publication Data

US 2008/0165016 A1 Jul. 10, 2008

Related U.S. Application Data

(60) Provisional application No. 60/855,894, filed on Oct. 31, 2006.

(51) Int. Cl.
*G08B 23/00* (2006.01)

(52) U.S. Cl. ..... 340/517; 472/33; 472/29; 340/573.1

(58) Field of Classification Search ..... 340/428, 340/429, 573.1, 692; 472/280, 297, 446, 472/482, 472, 15, 34, 10, 16, 30, 118; 446/411, 446/409

See application file for complete search history.

(56) References Cited

U.S. PATENT DOCUMENTS 2,765,168 A 10/1956 Taylor
3,147,972 A 9/1964 Borsuk
4,805,902 A 2/1989 Casagrande
5,103,511 A 4/1992 Sequin
5,154,658 A * 10/1992 Marcus ..... 446/411
5,525,113 A * 6/1996 Mitchell et al. ..... 472/119
5,754,094 A * 5/1998 Frushour ..... 340/384.7
5,859,638 A 1/1999 Colemann et al.
6,027,409 A 2/2000 Favorito et al.
6,339,304 B1 1/2002 Allison et al.
6,583,676 B2 6/2003 Krah et al.
6,814,670 B2 11/2004 Morita et al.
6,875,117 B2 4/2005 Ransil et al.
7,046,230 B2 5/2006 Zadesky et al.

(Continued)

FOREIGN PATENT DOCUMENTS

EP 0 268 495 5/1988

(Continued)

OTHER PUBLICATIONS

Boppy Rock in Comfort Travel Swing, Product Details, Model #32810, www.kidsii.com.

(Continued)

*Primary Examiner*—Daniel Wu
*Assistant Examiner*—Rufus Point
(74) *Attorney, Agent, or Firm*—Lempia Braidwood LLC

(57) ABSTRACT

A method of controlling a child motion device includes the steps of determining data indicative of motion of the child motion device, and controlling an audio output of the child motion device in accordance with the data. In some cases, the controlling step includes the step of modulating the audio output in accordance with the data. For example, the modulating step may involve applying a modulation effect to an audio track available to the child motion device.

21 Claims, 14 Drawing Sheets

U.S. PATENT DOCUMENTS

| | | | | |
|---|---|---|---|---|
| 7,419,436 | B2 * | 9/2008 | Ballin | 472/118 |
| 2003/0056288 | A1 | 3/2003 | Morita et al. | |
| 2003/0190967 | A1 * | 10/2003 | Henry | 472/128 |
| 2004/0259647 | A1 * | 12/2004 | Wood et al. | 472/119 |
| 2005/0283908 | A1 * | 12/2005 | Wong et al. | 5/109 |
| 2007/0129596 | A1 * | 6/2007 | Dickie | 600/26 |
| 2007/0205646 | A1 * | 9/2007 | Bapst et al. | 297/261.1 |
| 2008/0287035 | A1 * | 11/2008 | Ballin | 446/418 |
| 2009/0105001 | A1 * | 4/2009 | Burgaard et al. | 472/118 |
| 2009/0131185 | A1 * | 5/2009 | Speedie | 472/119 |

FOREIGN PATENT DOCUMENTS

| | | |
|---|---|---|
| EP | 1 186 264 | 3/2002 |
| EP | 1 010 448 | 6/2008 |
| WO | WO2007/056655 | 5/2007 |

OTHER PUBLICATIONS

Cypress "Motor Control with PSoC".

Magarita, Cypress MicroSystems Application Note AN2227, "Brushless DC Motor Control" (2004).

Seguine, "Avoid False Key Activations in Capacitive Sensing" (2006).

Pratt, Analog Devices Application Note AN-829, "Environmental Compensation on the AD7142: The Effects of Temperature and Humidity on Capacitance Sensors" (2005).

Pratt, Analog Devices Application Note AN-830, "Factors Affecting Sensor Response" (2005).

Seguine et al., Cypress MicroSystems Application Note AN2292, "Layout Guidelines for PSoC CapSense" (2005).

Seguine, Cypress MicroSystems Application Note AN2233a, "Capacitive Switch Scan" (2005).

Bokma et al., Cypress MicroSystems Application Note AN2277, "Capacitive Front Panel Display Demonstration" (2005).

Cypress Semiconductor Corporation product datasheet, "CSR User Module—CY8C21x34 Data Sheet" (2005).

Honeywell product datasheet, "Linear/Angular/Rotary Displacement Sensors" HMC1501/HMC1512.

Koteeswaran, Cypress MicroSystems Application Note AN2097, "Switch Mode Pump" (2003).

Kremin, Cypress MicroSystems Application Note AN2047, "Ultrasound Motion Sensor" (2002).

Cypress MicroSystems PCB circuit schematic, "CY3212—CapSense," Revision A (2005).

* cited by examiner

AUDIO MODULATION FOR A CHILD MOTION DEVICE

CROSS-REFERENCE TO RELATED APPLICATION

This application claims the benefit of U.S. provisional application Ser. No. 60/855,894, entitled "Motion Control Devices and Methods," and filed Oct. 31, 2006, the entire disclosure of which is hereby expressly incorporated by reference.

BACKGROUND OF THE DISCLOSURE

1. Field of the Disclosure

The present disclosure is generally directed to child or juvenile motion devices, and more particularly to devices and methods for controlling the motion in such devices.

2. Brief Description of Related Technology

Child motion devices such as conventional pendulum swings are commonly used to entertain and, sometimes more importantly, to soothe or calm a child. A child is typically placed in a seat of the device and then the device is directed to swing the child in a reciprocating pendulum motion.

Unfortunately, many child motion devices exhibit a lack of operational adjustability or adaptability. Past infant swings and other child motion devices have often been incapable of adapting to changing operational conditions. Such devices are likely to be well-suited for only a narrow range of children or operational circumstances. The inability to function correctly with child occupants failing outside a certain weight range is one example where past devices can fail to operate as intended.

Lack of customization options can be another source of inefficacy. Occupant preferences can vary significantly from child to child, as well as over time with a single child. Consequently, child motion products without available adjustments or customization options may be effective with only a small subset of children, and then only for only a short period of time.

The control techniques relied upon in past child motion devices have been known to suffer from a number of limitations. The control techniques, and the electronics and other components involved in implementing them, have often been inaccurate, inefficient, or both. This can often lead to operational drawbacks. For instance, the resulting motion can be bumpy or jolting for the child occupant, as the device generally fails to operate as intended. Other limitations of the control electronics and related components lead to inefficient operation, which can be significant as many child motion products are configured for battery power. Rapid depletions of battery capacity are then likely to lead to further operational problems.

These and other limitations of the control techniques and related components can ultimately result in the device being ineffective at calming, soothing or entertaining a child or infant occupant.

BRIEF DESCRIPTION OF THE DRAWING FIGURES

Objects, features, and advantages of the present disclosure will become apparent upon reading the following description in conjunction with the drawing figures, in which like reference numerals identify like elements in the figures, and in which.

Figure 1:
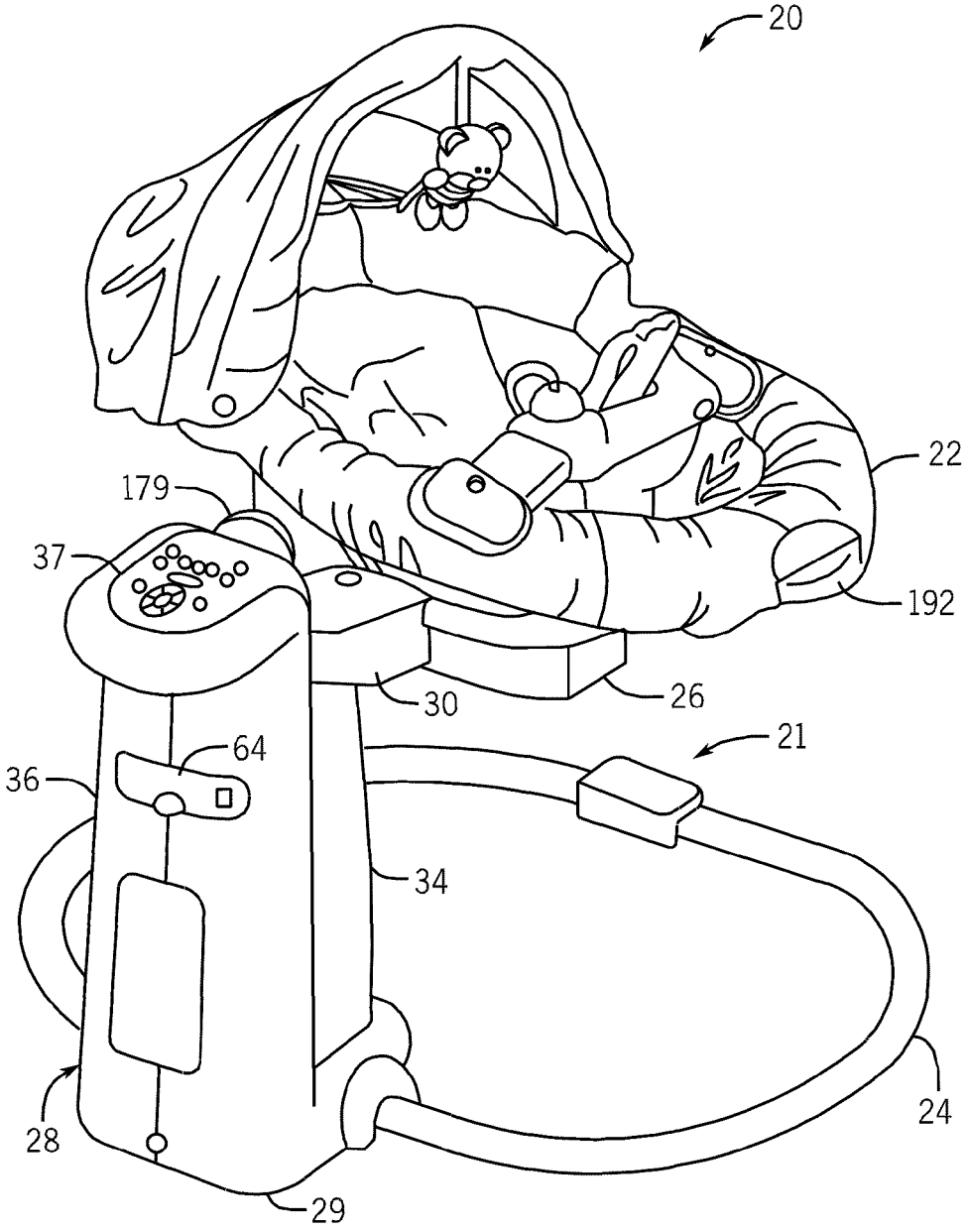
FIG. 1 is a perspective view of an exemplary child motion device controlled in accordance with various aspects of the disclosure.

While the disclosed systems, devices and methods are susceptible of embodiments in various forms, there are illustrated in the drawing (and will hereafter be described) specific embodiments of the invention, with the understanding that the disclosure is intended to be illustrative, and is not intended to limit the invention to the specific embodiments described and illustrated herein.

DETAILED DESCRIPTION OF THE DISCLOSURE

The disclosure is generally directed to child motion devices and control techniques for the implementation of motion-based functions and operations of such devices.

Several aspects of the disclosure are directed to a child motion device and control methods that provide a secure, comfortable, and soothing environment in an efficient and effective manner under a wide range of operating conditions. These aspects of the disclosure provide benefits to both the child and the caregiver by creating multiple, new ways for the caregivers to interact with their child and the device, by providing new soothing features that will help calm a fussy child, and by better functioning child motion devices. Several aspects of the disclosure involve or include the application of electromechanical technologies like capacitive sensing. As described below, some embodiments incorporate technologies like capacitive sensing in both user interface and motion control contexts, simplifying the electrical layout of the child device, and yet providing new features.

Some aspects of the disclosure involve the application of absolute swing angle sensing to provide more reliable and repetitive swing motion despite changes in operating conditions. Other aspects involve an automated, self calibration routine that results in greater tolerance and performance bands to be used in the device drive components, saving cost and reducing device component complexity. Still other aspects of the disclosure involve or include linking multiple product functions into pre-defined or user-defined modes. In this manner, the child device can be tailored to best soothe or entertain a child occupant while minimizing setup and configuration challenges otherwise imposed upon the caregiver.

Although described in connection with infant or child swings, the disclosed methods, devices and systems are well suited for use in connection with a variety of different child motion devices. Practice of the disclosed methods, devices and systems is accordingly not limited to the exemplary swings described herein.

In accordance with one aspect of the disclosure, the methods and devices described herein determine position data in real-time to apply power at correct points within the motion path of the child motion device. For example, applying power at the correct points during a pendulum arc can provide efficiency advantages when the underlying position (or swing angle) data is determined in an accurate manner as described below.

The various position and angle sensing techniques described below may be used to implement functions other than motion control feedback. In some cases, the same techniques may be utilized to support both motion control and other functions. Moreover, some techniques may be used in combination to supplement or facilitate the motion control feedback or other functionality.

In accordance with other aspects of the disclosure, optimization of the operation of the motor is addressed via methods and techniques that implement periodic or regular calibration of the motor voltage. Such automatic calibration may adjust the voltages that work best or most efficiently during, for example, start up or other in-use conditions. In some cases, implementation of the methods and techniques results in a range of suitable voltages from which a controller can select a desired level for operation.

Figure 2:
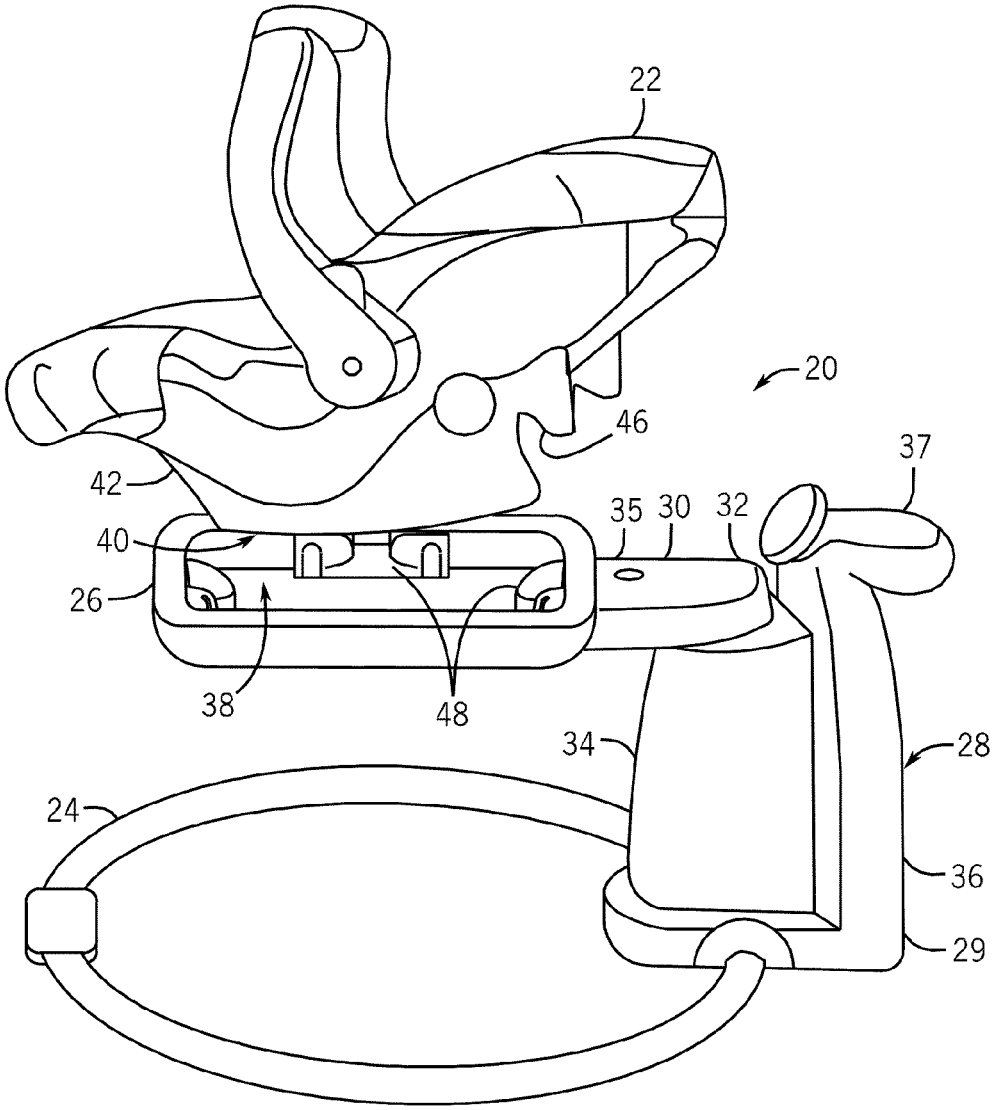
FIG. 2 is a perspective view of the child motion device of FIG. 1 with a seat shown in exploded view for mounting in one of several optional seating orientations.
Figure 3:
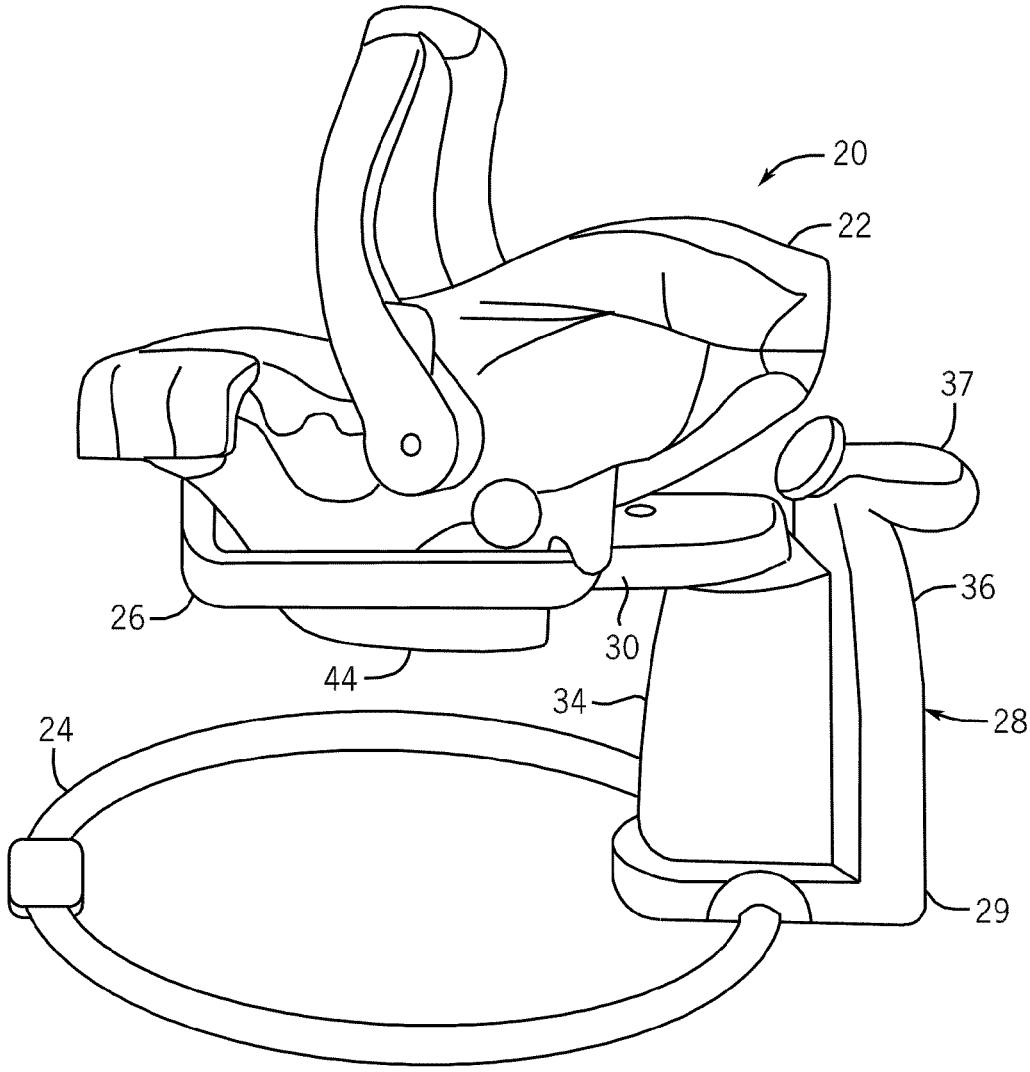
FIG. 3 is a perspective view of the child motion device of FIG. 1 with the seat mounted in one of the optional seating orientations.

Turning now to the drawing figures, FIGS. 1-3 show one example of a child motion device 20 incorporating various aspects of the disclosure. The device 20 in this example generally includes a frame assembly 21 configured to support an occupant seat 22 above the surface upon which the device 20 is disposed. A base section 24 of the frame assembly 21 rests upon the surface to provide a stable base for the device 20 while in-use. The frame assembly 21 also includes a seat support frame 26 on which the seat 22 is mounted. The seat frame 26 is generally suspended over the base section 24 to allow reciprocating movement of the seat 22 during operation. To that end, an upright post 28 of the frame assembly 21 extends upward from the base section 24 to act as a riser or spine from which a support arm 30 extends radially outward to meet the seat frame 26.

In this example, the post or spine 28 is oriented in a generally vertical orientation relative to its longitudinal length. The post 28 has an external housing 29 that may be configured in any desired or suitable manner to provide a pleasing or desired aesthetic appearance. The housing 29 can also be functional, or both functional and ornamental. For instance, the housing 29 can act as a protective cover for the internal components, such as the drive system, of the device 20. Some or all of the housing 29 may constitute a removable cover for access to the interior or inner workings of the device 20, if needed. In any case, the housing 29 and, more generally, the post 28, may vary considerably in orientation, shape, size, configuration, and the like from the examples disclosed herein.

Other components of the frame assembly 21, such as the base section 24, may also vary considerably in orientation, size, shape, configuration, and the like. Practice of the disclosed methods and devices is not limited to the configuration of the exemplary frame assembly 21 described and shown in connection with FIGS. 1-3. Notwithstanding the foregoing, one or more components of the frame assembly 21 may be well suited for implementation of one or more aspects of the disclosure, as described below.

Figure 4:
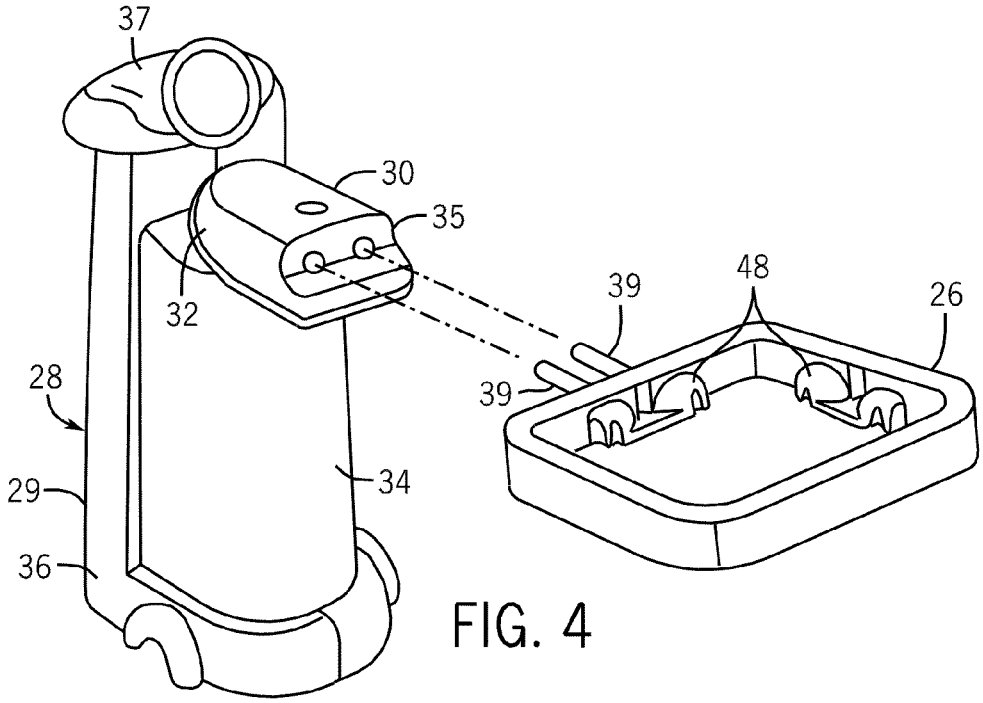
FIG. 4 is a perspective view of a post and a seat base of a support frame of the child motion device of FIG. 1 shown in exploded view.

As best shown in FIGS. 2 and 4, a driven end 32 of the support arm 30 is coupled to a structural support, or weight bearing, portion 34 of the post 28. In this example, the support arm 30 is cantilevered from the post 28 at the driven end 32. The support arm 30 is mounted for pivotal, side-to-side movement about its driven end 32 through a travel path that is substantially horizontal. Further details regarding the travel path, as well as other exemplary travel paths, can be found in U.S. Patent Publication No. 2007/0111809, entitled "Child Motion Device," the entire disclosure of which is hereby incorporated by reference. As described therein, the support arm 30 can travel through a partial orbit or arc segment of a predetermined angle and can rotate about an axis of rotation that can be offset from a vertical reference and that can be offset from an axis of the post 28. Alternatively, the axis of rotation can be aligned with the vertical reference, the axis of the post 28, or both, if desired. More generally, the driven end 32 is coupled to a drive system (FIGS. 6-8) disposed within the housing 29 and designed to reciprocate or oscillate a distal end 35 of the support arm 30 to which the seat frame 26 is i attached for corresponding movement of the occupant seat 22.

As described below, the device 20 includes a number of components directed to controlling and/or facilitating the motion and other functionality of the device 20. In the example shown, several of these control components are disposed on or in a control tower 36 of the post 28. In some cases, the control tower 36 may also contain portions of the drive system or structural support elements of the device 20. In this example, the control tower 36 has an upper panel 37 to present an instrumentation, or control, interface to a caregiver directing the operation of the device 20. The positioning and configuration of the instrumentation and other interface elements may vary considerably from that shown. For instance, the instrumentation need not be arranged in a single panel, but rather may be distributed over multiple locations on the control tower 36 or other component of the device 20. Further description of the elements and aspects of the user interface are set forth below.

In the example shown in FIGS. 1-3, the base section 24 of the frame assembly 21 is in the form of an oval hoop or ring sized to provide a stable base for the device 20 when in use. The configuration of the base section 24 can vary from the hoop as discussed in the above-referenced publication. The base section 24 is positioned generally beneath the seat support frame 26 in order to offset the load or moment applied to the post 28 and created by a child placed in the seat 22 of the cantilevered support arm 30.

The seat support frame 26 may vary considerably and yet fall within the spirit and scope of the present invention. In this example, the seat support frame 26 is a square or rectangular ring defining an opening 38 (FIG. 2) to accept the seat 22. The seat frame 26 may have a pair of pins 39 extending outward from one side to engage corresponding, locking receptacles in the distal end 35 of the support arm 30, as shown in FIG. 4.

While other configurations and constructions of the seat support frame 26 are possible, the symmetrical shape of the seat support frame 26 permits the seat 22 to be mounted on the support arm 30 in a number of optional orientations. In this example, the child seat 22 can have a contoured bottom or base 40 with features configured to engage with portions of the seat support frame 26 so that when it is rested on the seat support frame, the child seat 22 is securely held in place. In this example, the seat support frame 26 is formed of tubular, linear side segments. The seat bottom 40 may have a number of side or end regions 42 that either rest on or engage respective linear side segment of the support frame 26. A depending region 44 (FIG. 3) of the seat base 40 is sized to fit within the opening 38 of the support frame 26. The other end of the base 40 has one or more aligned notches 46 that are configured to receive the opposite linear side segment of the holder. The depending region 44 and the notches 46 hold the child seat 22 in place on the holder. Gravity alone can be relied upon to retain the seat in position. In another example, one or more positive manual or automatic latches 48 (FIG. 2) can be employed. In this example, the latches 48 are disposed as part of the seat support frame 26. Alternatively or additionally, the latches 48 may be formed as part of the seat 22, at one or both ends of the seat 22, and/or at one or both ends of the seat support frame 26 to securely hold the child seat 22 in place on the seat support frame 26. The latches 48 can be spring biased to automatically engage when the seat is placed on the holder.

The geometry and symmetry of the latches 48 and, more generally, the seat support frame 26, in this example allows the seat 22 to be placed in the holder in multiple optional seat orientations. In FIG. 1, the seat 22 is oriented such that a side of the seat 22 is closest to the post. By de-coupling the seat 22 from the seat support frame 26, the seat 22 may be re-oriented to the position shown in FIG. 3 such that the child is facing away from the post 28. Further information regarding the seat orientation options is set forth in the above-referenced publication. As also discussed therein, the seat 22 and/or the seat support frame 26 can also be configured to permit the inclination of the seat 22 or the frame 26 to be adjusted to various recline angles. More generally, the disclosed devices and methods are well suited for use with a variety of seats, seat orientations, and seat mounting configurations. For example, in some cases, the seat frame 26 may be configured to accept and support a seat or other child carrying device from another product, such as a car seat.

Figure 5:
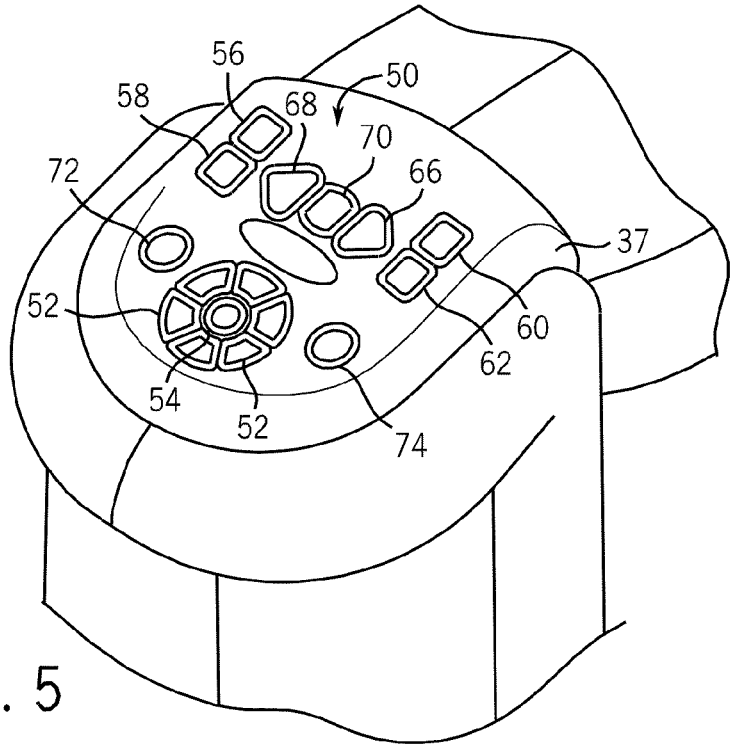
FIG. 5 is a perspective view of a portion of the post of FIG. 4 to show a user interface panel in greater detail.

With reference now to FIG. 5, the operation and functionality of the device 20 is described in connection with an exemplary user interface indicated generally at 50. The user interface 50 is disposed on the upper panel 37 as described above, but the physical location and arrangement of any one or more elements of the user interface 50 may vary considerably. Generally speaking, the user interface 50 includes a number of elements that provide functions and operations for selection by user. The user interface 50 also provides to the user information regarding the current selection or other operational status of the device 20. The user selection and status information aspects of the user interface 50 may be integrated to any desired extent. For example, an element of the user interface 50 may present both a user selection option as well as status information. To this end, a user interface element may include a user select, or button, for actuation by a caregiver, as well as an output indicator, or light, the activation of which may occur with the selection thereof. Each of the elements of the user interface 50 described below may, but need not, provide this dual functionality. Any one or more elements of the user interface 50 may also provide such functionality in connection with multiple operations, functions or aspects of the device 20. Moreover, some user interface elements may provide multiple control options depending upon the manner in which the element is selected by the caregiver. For example, a user interface element may initiate different control actions depending on how long the button is depressed (e.g., "press and hold" actuation), or whether the user interface element is responsive to motion (e.g., a slider).

In this example, the user interface 50 includes a set of speed selects 52 in an arrangement surrounding a motion ON/OFF select 54. Actuation of the speed select 52 labeled "1" directs the device 20 to drive the seat 22 (FIGS. 1-3) through a short range of motion and, accordingly, a low speed. Progressively higher speed select numbers increase the range of motion and speed of the device 20, with the speed select 52 labeled "6" associated with the full range of motion of the device 20 and the highest speed. Actuation of the motion ON/OFF select 54 either discontinues motion of the device 20 or activates the device 20 at the last selected speed. In alternative embodiments, the select 54 may control the activation and deactivation of the device 20 rather than only the motion aspects thereof.

The manner in which the user selects 52 and 54 are actuated may vary considerably. In one embodiment, each user select 52, 54 is a mechanically actuated button switch. Alternatively, the user selects 52, 54 are actuated via another mechanism, such as a sensed capacitance. In other cases, the user selects 52, 54 may involve a combination of mechanical and capacitive actuation mechanisms. In still other cases, the user selects 52 may be integrated as a slider interface instead of a set of individual, binary switches. Further information regarding the actuation and operation of capacitive switches or sensors is set forth below.

The user interface 50 includes a set of selects generally directed to controlling sound or music functionality of the device 20. Generally speaking, a caregiver may select the reproduction of various types of sounds or music. In this example, two different styles of music, playful and soothing, are available via the actuation of user selects 56 and 58, respectively. A number of music tracks may be accessed via repeated actuation of one of the selects 56, 58. Otherwise, the music tracks are reproduced in turn and then begin again with the first track. If music is not desired, the reproduction of soothing sounds is available via the actuation of a user select 60. Repeated actuation of the select 60 toggles through a number of soothing sounds, such as that of a stream, forest, distant storm, or womb. Reproduction of the selected sound continues until a different sound is selected, a different user select causes music playback, or the playback times out as described below.

User select 62 supports the reproduction of music or other sounds stored on, or provided by, a music playback device (not shown), such as an MP3 player. Further control of music playback, including in some cases volume control, may then be directed via the music playback device. A compartment or drawer 64 (FIG. 1) may include a tray for storage of the playback device. A cable or other interface is then provided in the compartment for connection of the playback device to the device 20.

The user interface 50 also includes selects 66, 68 for volume control upward and downward, respectively. Actuation of an ON/OFF select 70 either activates or deactivates the reproduction or playback of music or sounds. Actuation of a timer select 72 starts a device timer of a predetermined duration, such as 30 minutes, at the end of which both sound functions and motion functions are shut down. Lastly, the user interface 50 includes a parental lock select 74 that may be actuated to either lock or unlock the user interface 50 via a press-and-hold operation. In this manner, the device 20 may be locked into any current operational state involving any one or more device functions.

The layout and functionality of the user interface 50 may vary considerably. For instance, the arrangement, shapes and sizes of the user interface selects and other elements may differ markedly from that shown in FIG. 5. Still further, any number of the functions provided via the user interface selects may be aggregated and addressed via, for instance, a touch-sensitive display screen or other panel that supports a variable display. In these and other ways, the same user select(s) may be used to control disparate functions. For example, a touch-sensitive slider element may support graduated or analog adjustments for a variety of control options. Other user selects, such as buttons of either a conventional switch or capacitive sensing nature may then be used to determine what function is controlled by the slider element. For instance, volume control, swing motion speed, and timer functions may be adjusted via one or more slider elements. The user interface may then include a series of visual elements to reflect the degree to which the slider element is actuated.

The functions and operations described above in connection with the user interface 50 may be controlled or selected individually or collectively. As described below, a set of functions may be grouped or associated such that user selection of the group collectively activates, deactivates or otherwise controls multiple aspects of the device 20. The set of functions or operations, together with the specific selections, thereby define an operational mode of the device 20. Operational modes may be predetermined in various ways. In some cases, the mode(s) are defined and stored as factory settings. Alternatively or additionally, the mode(s) are defined by a user and stored.

Figure 6:
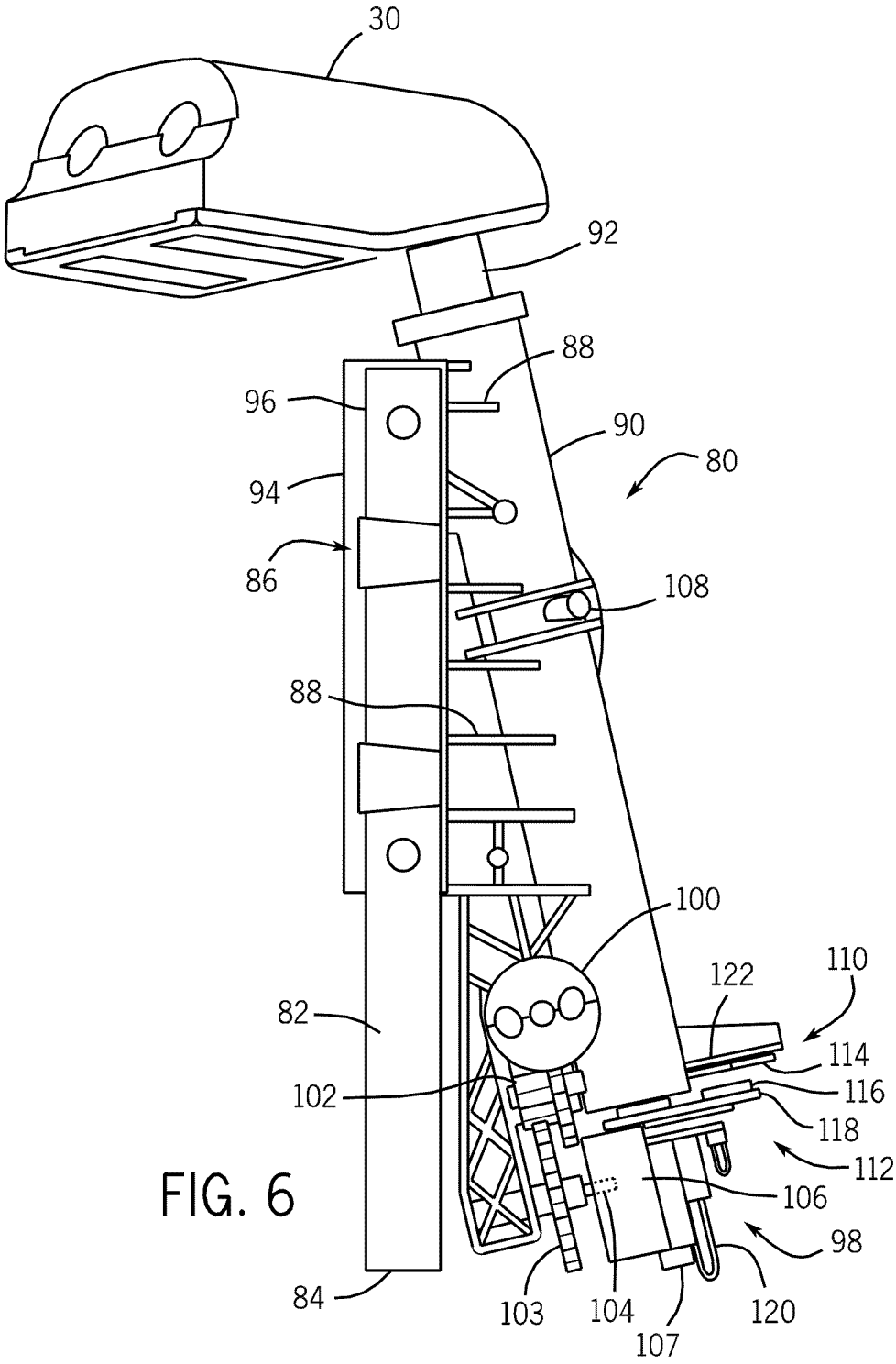
FIG. 6 is a perspective view of exemplary drive and motor control feedback systems configured in accordance with one embodiment and shown removed from a housing of the post of FIG. 4 in which the systems are disposed.

FIG. 6 shows an exemplary support and drive assembly indicated generally at 80. A number of components of the assembly 80 may correspond with portions of the post 28 (FIGS. 1-4). However, the assembly 80 is shown without a cover or housing for convenience in illustration of the inner workings, or internal components, thereof. The assembly 80 is also shown without components involved in the attachment to the base section 24 (FIGS. 1-3), which may vary considerably while providing structural support. In one example, such structural connection components include a box-shaped frame (not shown) that couples the base section 24 to the assembly 80 by engaging both the base section 24 and a pair of support columns 82. To this end, lower ends 84 of each column 82 may be captured by the frame. From that lower connection, the columns 82 extend upwardly toward a skeleton frame 86 that links the columns 82 to a drive system indicated generally at 86. The frame 86 includes a number of ribs 88 that structurally link a sleeve 90 surrounding a drive shaft 92 to a retainer 94 that contains the columns 82 near upper ends 96 thereof.

In this example, the shaft 92 is a tube-shaped rod connected within the assembly 80 to transfer motion from a drive system indicated generally at 98 to the support arm 30. The shaft 92 is extends upward from the drive system 98 at an angle relative to the generally upright columns 82 to reach the support arm 30 as the shaft 92 extends beyond the sleeve 90. In operation, an electric motor 100 (e.g., a DC electric motor) drives a gear train having a worm gear 102 and a worm gear follower 103 carrying a pin or bolt 104, which acts as a crank shaft. In this case, the motor 100 always turns in the same direction. The pin 104 is displaced from the rotational axis of the gear follower 103 such that rotation of the gear follower 103 causes the pin or bolt 104 to proceed in a circular or rotary path. The free end of the pin 104 extends into a vertically oriented slot of a U-shaped or notched bracket 106 coupled to the shaft 92. In this way, the movement of the pin 104 along the circular path is transformed from pure rotary motion into the oscillating or reciprocating motion of the shaft 92. Despite the single direction of the motor 100, the notched bracket 106 is displaced in one direction during one half of the cycle, and the opposite direction during the other half of the cycle. The energy of the crank shaft transferred to the notched bracket 106 then acts on a swing pivot shaft 107 via a spring (not shown). The swing pivot shaft 107 is then linked or coupled to the drive shaft 92 to oscillate the support arm 30 through its motion pattern.

The spring can act as a rotary dampening mechanism as well as an energy reservoir. The spring can be implemented to function as a clutch-like element to protect the motor by allowing out-of-sync motion between the motor 100 and the shaft 92. Thus, the shaft 92 in this case is not directly connected to the motor 100 (i.e., an indirect drive mechanism). In such cases, rotational displacement of the shaft 92 and, thus, the travel of the support arm 30, may be limited by a bolt 108 projecting through the shaft 92. The bolt acts upon a physical hard stop, such as part of the skeleton frame 86, to define the maximum swing angle.

Practice of the disclosed devices and methods is not limited to the above-described indirect drive technique, but rather may alternatively involve any one of a number of different motor drive schemes and techniques. As a result, the components of the drive system can vary considerably and yet fall within the spirit and scope of the present invention. The exemplary drive system 98 provides reciprocating motion well-suited for use in connection with a child motion device, inasmuch as the drive mechanism and the mechanical linkage thereof allow for some amount of slippage in the coupling of the motor to the occupant seat. Nonetheless, there are certainly many other possible drive mechanisms or systems that can alternatively be employed to impart the desired oscillatory or reciprocating motion to the support arm 30 of the devices disclosed herein.

One such technique involves a direct drive mechanism in which the motor shaft is mechanically linked to the swing pivot shaft without allowing for any slippage. In this case, the motor may be driven in different directions via switched motor voltage polarity (i.e., forward and reverse drive signals) to achieve the reciprocating motion. The mechanical linkage is then configured to accommodate the bi-directional motion, unlike the worm gear 102 and other mechanical linkage components in the drive system 98 described above, The motor can be powered in either an open-loop or closed-loop manner. In an open-loop system, electrical l power is applied to the motor with the alternating polarities such that swing speed (or swing angle amplitude) may be controlled through adjusting either applied voltage, current, frequency, or duty cycle. An alternative system applies power at a fixed polarity with the reciprocating motion developed via mechanical linkage. Closed-loop control of a direct drive system may involve similar control techniques to those implemented in open-loop control, albeit optimized via the feedback techniques described below. With the feedback information, the applied voltage and other parameters may be adjusted and optimized to most efficiently obtain or control to desired swing amplitudes.

Other optional drive techniques may include or involve spring-operated wind-up mechanisms, magnetic systems, electromagnetic systems, or other devices to convert drive mechanism energy and motion to the reciprocating or oscillating motion of the disclosed devices.

The drive system 98 described above is shown in greater detail in FIGS. 7 and 8 in connection with one example of a sensor assembly 110 configured to provide feedback for motor control and other device functionality in accordance with various aspects of the disclosure. While the sensor assembly 110 is well suited for implementation with the indirect drive system 98, the sensor assembly 110 may be integrated and utilized in conjunction with any one of the different drive systems identified above.

The sensor assembly 110 is disposed in proximity to the drive system 98 to capture information regarding the motion thereof. The information may be indicative of relative or absolute position of the swing or other element in motion, the direction of motion, or speed. In this example, the sensor assembly 110 is mounted to the drive system 98 at the lower end of the sleeve 90, near the motor 100 and the gear train, but this need not be the case. In other cases, the sensor assembly 110 may be mounted anywhere along the drive system 98 and, more generally, at any position providing access to the motion for which the information is to be captured. For example, the sensor assembly 108 may be in communication with the drive system 98 at or near the upper end of the sleeve 90.

The sensor assembly 110 is generally directed to improving the motion control of the child device and, in some cases, enabling additional functionality of the child device. For example, improved motion control may include, involve or result in more repeatable swinging motion and more consistent swinging motion during different operating conditions, increased product reliability, and more robust and complex device operation. These and other advantages can result in more beneficial device performance as exemplified through improved device efficacy in child soothing and entertainment. The information gathered by the sensor assembly 110 may also be utilized to control the child device in other ways as well, as described below. These other ways may involve or include the implementation of non-motion functions of the child device, such as audio functions.

To these and other ends, the sensor assembly 110 includes a feedback sensor 112 that monitors the reciprocating (or other) motion of the drive system 98. The feedback sensor 112 may be electrical, electromechanical, electromagnetic (e.g., optical), inductive, ultrasonic, piezoelectric, or various combinations thereof. In some cases, the sensor assembly 110 includes multiple feedback sensors, or feedback sensing mechanisms, to provide different types of information and/or data redundancy. Thus, the manner in which the sensor assembly 110 and the drive system 98 are in communication may vary considerably.

In this example, the feedback sensor 112 includes a capacitive sensor board 114 spaced from a metallic disk 116 coupled to the drive system 98. The disk 116 is carried on a finger 118 best shown in FIGS. 7 and 8. The finger 118 is coupled to the notched bracket 106 and the swing pivot shaft 107 via a retaining pin 120. Reciprocating motion of these elements of the drive system 98 cause the disk 116 to pass across (e.g., under) the sensor board 114. The sensor board 114 may be arc-shaped to accommodate the reciprocating motion, and rigidly secured to the drive system 98 via an arm or platform 122 extending radially from the sleeve 90.

The operation of the capacitive sensing technique generally involves the detection of a change in capacitance caused by the proximity of the metallic disk 116 to conductive lines, or traces (FIG. 10) disposed on the sensing board 114. To that end, any capacitance altering object may be used. The surface area, or width, of the disk 118 or other object may be selected in accordance with the spacing between the traces. For example, the ratio of the object width to the trace spacing may be about 3:2.

Figure 7:
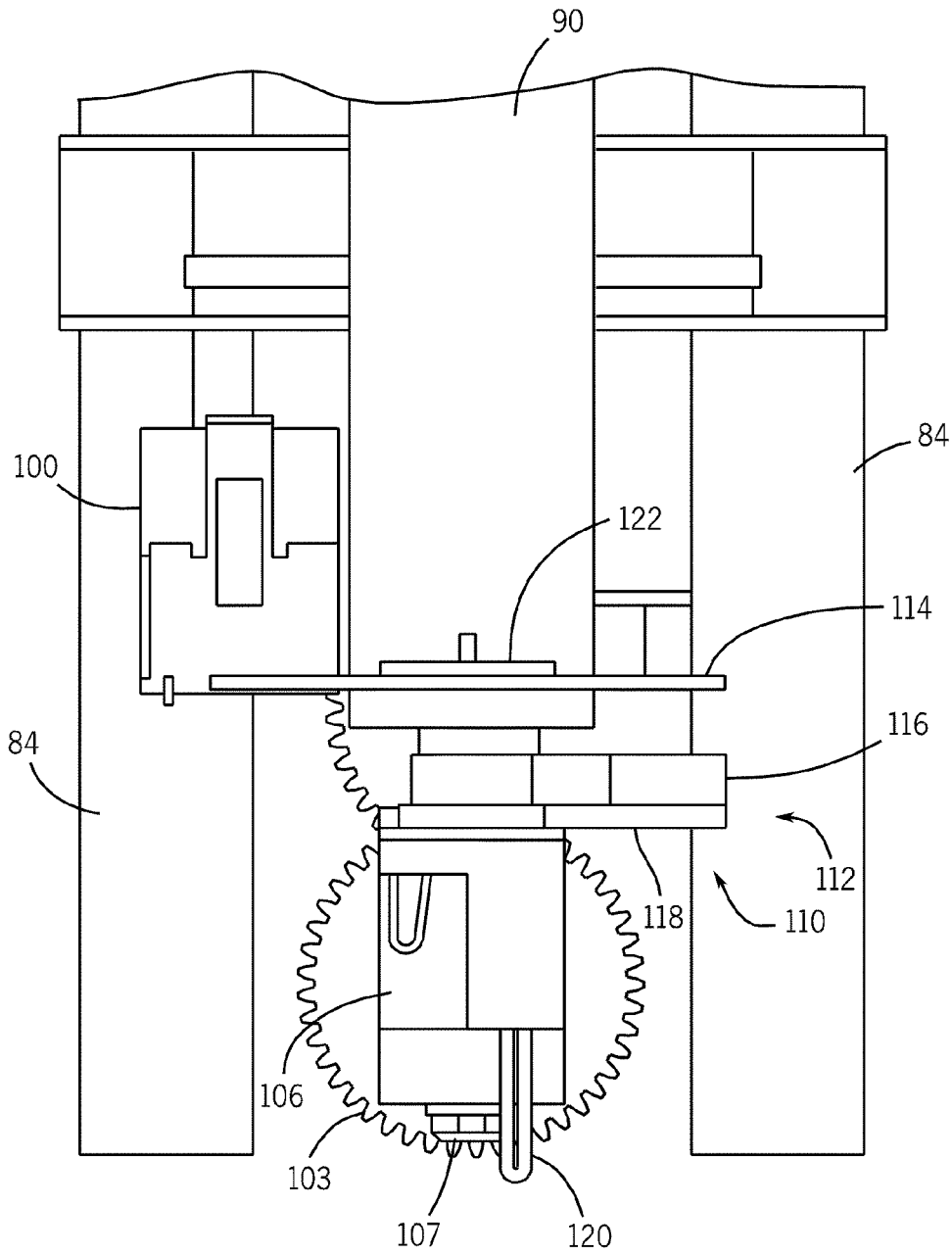
FIG. 7 is an elevational view of the drive and the motor control feedback systems in greater detail.
Figure 8:
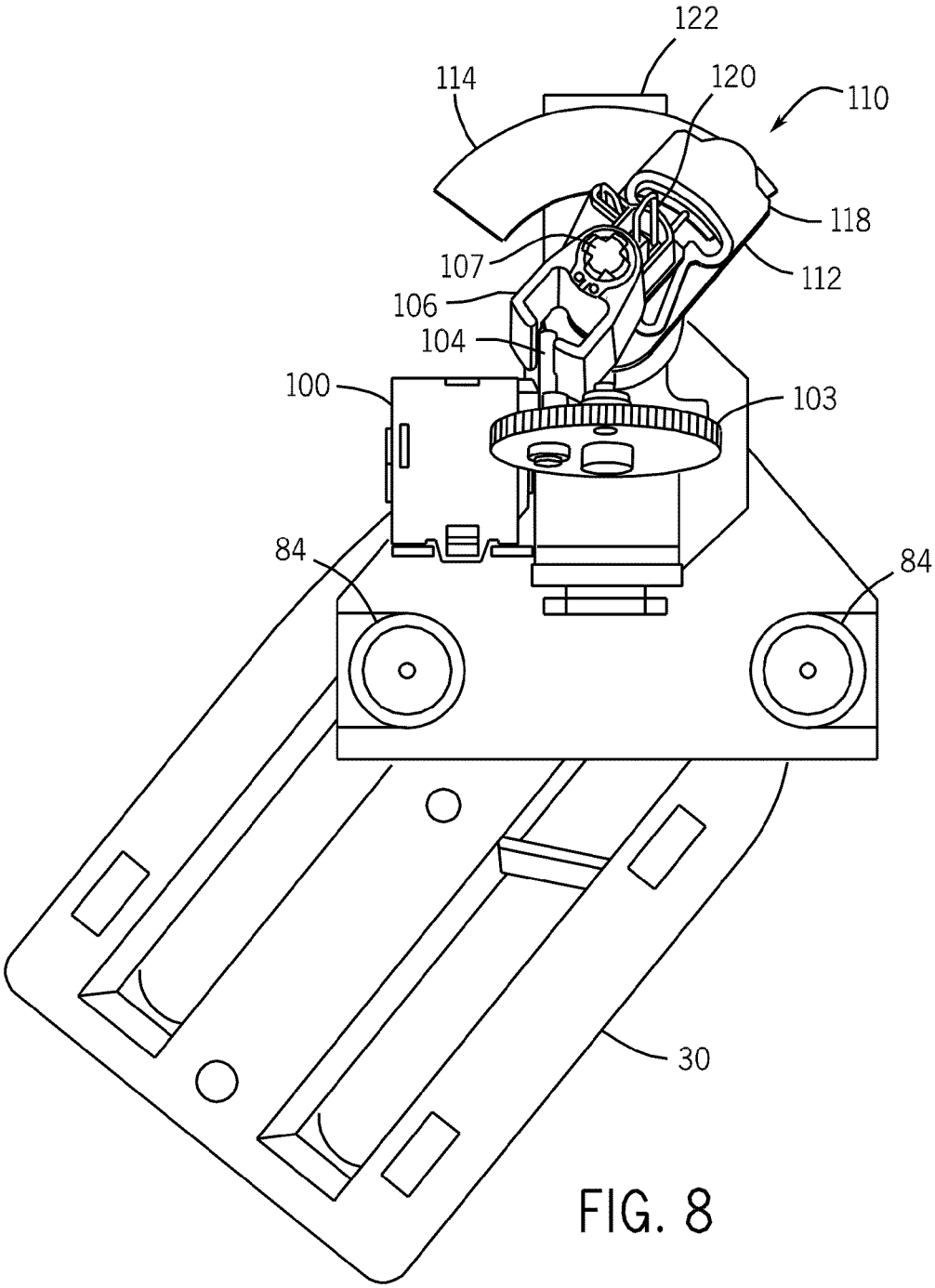
FIG. 8 is a bottom view of the drive and motor control feedback systems.

While further details regarding the capacitive sensing technique implemented via the exemplary sensor shown in FIGS. 6-8 are set forth in the description below, it is worth noting that this technique (as well as other techniques identified herein) can generally obtain an indication of the absolute angle or position of a swing operated by the drive system. The absolute angle or position is to be contrasted from the relative angle or position of a swing operated by the drive system 98. The relative swing angle refers to the fact that the endpoints of the swing angle can be shifted relative to the earth due to a "center of gravity" shift in the seat 22 of the device 20 (FIGS. 1-3). More specifically, the swing stroke endpoints are, without more information, not correlated to a fixed position on the ground within a specific tolerance. The relative swing angle refers to half of the total angle traveled by the swing. This total angle may be greater in the forward or back half of the swing stroke when compared to vertical. Adjusting this swing angle is directly related to the 'speed' a child perceives while sitting in the seat. A larger angle equates to greater swing speed. Therefore it is beneficial to create a feedback loop that monitors this relative angle and controls the swing motion to predetermined amplitudes.

Other feedback techniques suitable for capturing information such as the relative swing angle include or involve (i) ultrasonic techniques using piezoelectric sensors mounted at points on the device to measure a distance varying with device motion, (ii) laser or other optical techniques similarly measuring a varying distance, (iii) encoder-based techniques driven by the motion of the pivot shaft to provide a pulse train indicative of the motion, (iv) magneto-resistive arrangements positioned to detect motion via a corresponding change in a sensed magnetic field, (v) a combination of limit switches, proximity sensors, and Hall-effect sensors in various locations on the device such that their activation and deactivation caused by the motion of the swing is indicative of the position of the swing, and (vi) a motor control feedback loop based on the voltage induced in the motor windings, i.e., the "back EMF" (electromotive force) technique. In the back-EMF technique, the motor windings function as position sensors during rotor movement. To this end, the motor winding, working in sensor-position mode, is disconnected from the power line supply. An induced voltage is then generated on the winding by the revolving magnet on the motor rotor. The sign and direction of the voltage change indicates the rotor pole location relative to fixed stator windings. The voltage polarity and magnitude is then directly correlated to the seat angle's amplitude. Due to the design of, for instance, a DC electric motor, voltage will be generated in pulses, the time between which and magnitude thereof is a function of the speed at which the motor is being driven by the swing. The pulse train (and amplitude envelope) can be translated to a swing motion curve. As described below, the output voltage resulting from the back-EMF technique, or any of the other techniques, can then be monitored by a control circuit with an analog voltage input, as shown and described below in connection with the exemplary control circuit of FIG. 10.

With the addition of an indexing device, such as a limit switch (not shown), configured to be activated at a specific position, the aforementioned techniques may be utilized to determine the true position or swing angle of the device. Upon the first complete revolution of the motor, the indexing device will have determined a reference point (i.e., position) with which the position data to follow can be compared. In this way, the above-described techniques can generate data indicative of the exact position of the motor, shaft, swing seat, etc. at any instance, and in real time.

Moreover, if the motion is indexed with a known, initial reference point, the absolute swing angle or position relative to the ground surface can be determined. For instance, the initial reference point can be mechanically determined (e.g., via a factory-set motor alignment) or via another switch or sensor device positioned accordingly.

Generally speaking, the implementation of one or more of these feedback mechanisms facilitates the application of power to the motor in an efficient manner. With the information or data captured via the feedback mechanisms, the relative or absolute position or angle of the swing is more accurately known, such that the application of power to the motor can be timed to produce the greatest effect. This level of detail contrasts from past sensing techniques that provided only the direction of motion, or an inaccurate, relative indication of position or swing angle. Such techniques may have involved a single slotted photo-interrupter, which even when duplicated, can only provide indications of relative position and direction. In contrast, the techniques addressed and described herein provide an accurate indication of absolute, or true, position that can facilitate and support the implementation of a variety of functions and operations.

In some cases, two or more of the techniques addressed herein may be implemented in combination to further optimize motor performance. For instance, the back EMF technique may be combined with the above-described capacitive sensing technique. In that case, the combination obtains speed and direction information from the signal provided by the back EMF, and position data from capacitive sensing. As described below, these two techniques may also advantageously utilize the same controller or control circuitry for efficient processing.

Further details regarding the use of angle or position information for motor control and other functionality is now set forth in connection with an exemplary embodiment utilizing capacitive sensing techniques. As described above, a capacitive sensing technique can provide a low-cost, non-contact mechanism for determining an absolute swing angle measurement.

Figure 9:
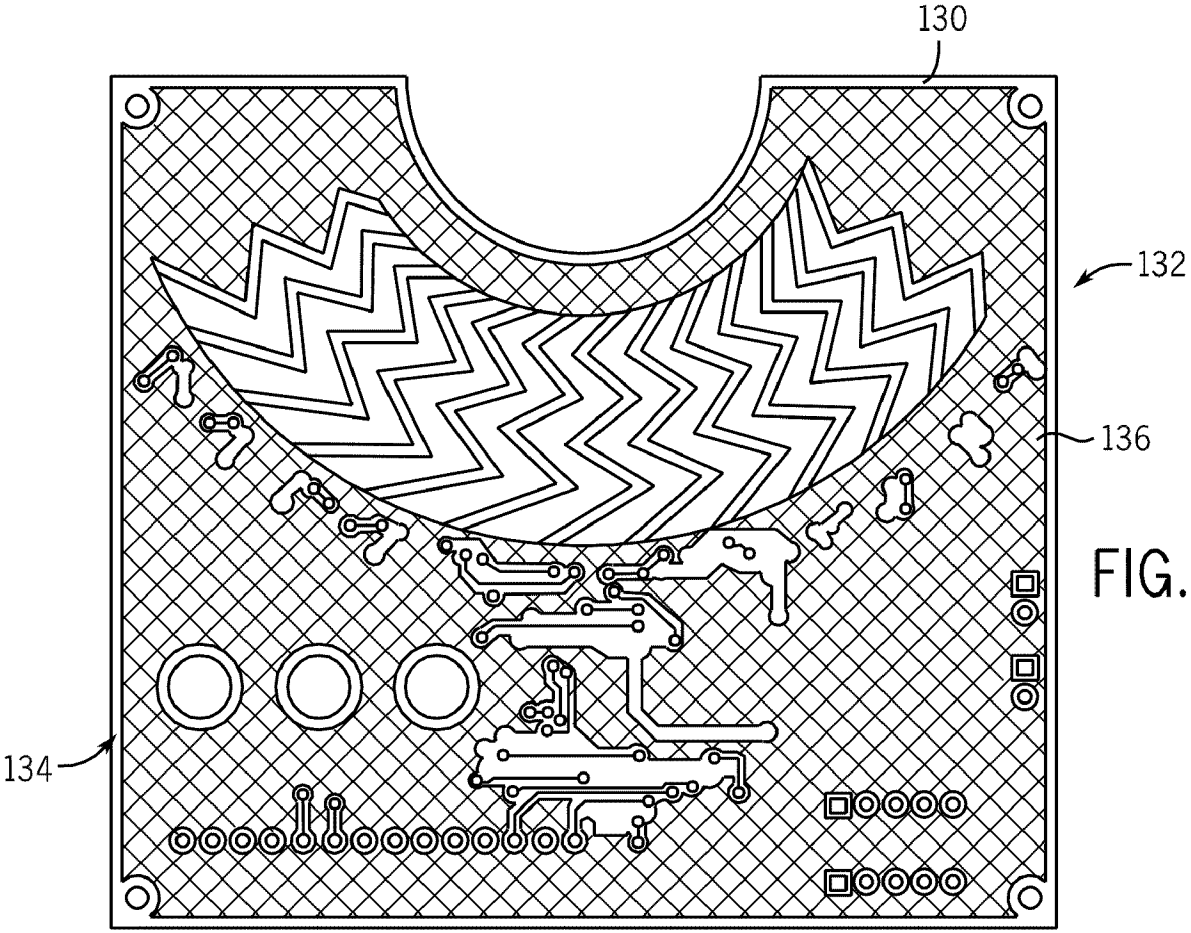
FIG. 9 is a schematic view of an exemplary sensor board of the motor control feedback system and/or user interface of one of the child motion devices of FIGS. 1 and 9 and in accordance with certain aspects of the disclosure.

With reference now to FIG. 9, one example of a sensing board 130 includes a motion control set of traces disposed in an area indicated generally at 132 and a user interface set of traces disposed in an area indicated generally at 134. Further details-regarding the user interface functionality is set forth below. Each set of traces is configured to exhibit a capacitance level that is modifiable to a detectable extent when an object is in proximity thereto. The traces in the area 132 may have a zigzag shape to increase the capacitance modulation as the conductive disk 118 (FIG. 8) or other object passes over (or under) the traces in close proximity thereto. The board 130 may include a backplane 136 that presents a mesh or other pattern (shown in areas other than the areas 132, 134) to enhance the variability of the capacitance level. The traces and backplane may, but need not, be disposed on a printed circuit board (PCB) or similar medium. In some cases, the traces may be disposed in a ribbon cable or other flexible medium. Alternatively or additionally, the traces may be disposed on opposite sides of the same medium.

In operation, the motor control functionality involves a controller alternately applying and reading analog voltages on the zigzag-shaped traces in the area 132, as the traces are passed over by an electrically conductive "finger" in the particular sequence defined by the arrangement. In one example, this operational sequence involves the controller charging a trace, and then monitoring the discharging to determine the RC time constant of the trace. In some cases, the controller drives other traces to ground during the charging and monitoring sequence. With the RC time constant data, the controller can calculate the sensed capacitance to determine whether the conductive finger is present. The determination may involve a threshold comparison for the single trace as well as more complex procedures involving the determinations associated with adjacent traces. To these ends, the controller (or control circuit) may include an analog voltage sensor or analog-to-digital converter (ADC) to sample and capture the voltage on each trace. The digital data indicative of the sensed voltages is then processed to determine the actual position of the swing. Further description of an exemplary control circuit is set forth below in connection with FIG. 11.

Figure 10:
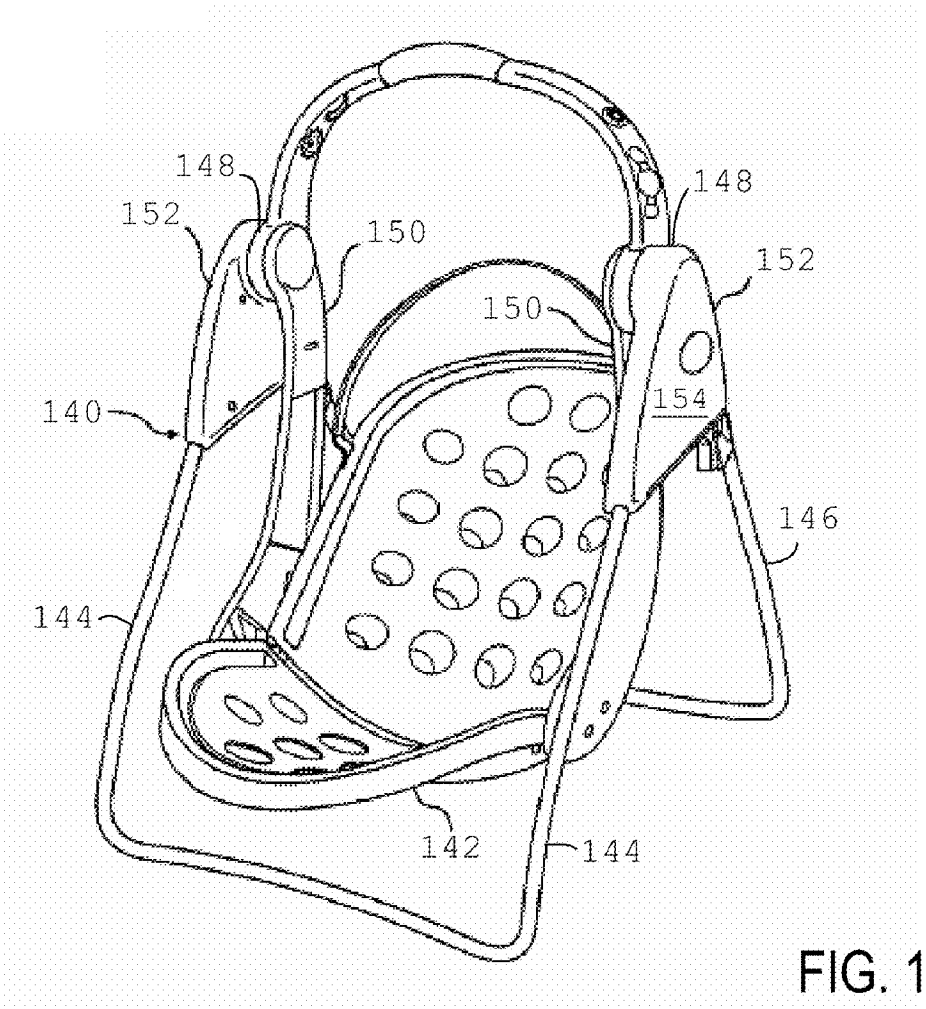
FIG. 10 is perspective view of an alternative child motion device suitable for incorporation of the sensor board of FIG. 9 for facilitating motor control and user interface functionality in accordance with one aspect of the disclosure.

In accordance with one aspect of the disclosure, the exemplary sensing board 130 shown in FIG. 9 exemplifies how the components of a capacitive sensing technique may be utilized to implement both motor control and user interface functionality. In many cases, the same control circuit may be utilized to charge and discharge the traces associated with motor control and other functions, such as a user interface. In some cases, the same sensing board may also be utilized for both motor control and user interface functionality. For example, FIG. 10 depicts a child swing 140 having a typical A-frame configuration in which an occupant seat 142 is suspended between frame legs 144 and 146, respectively, that are arranged to meet at pivot joints 148. The seat 142 is coupled to the pivot joints by hanger arms 150 that oscillate in the reciprocating motion to be detected via the capacitive sensing technique. At one or both of the pivot joints 148, the control circuitry for the capacitive sensing technique is contained within a housing or enclosure 152. On an interior facing side of the housing 152 (i.e., the side facing the hanger arms 150 and the seat 142), the hanger arms 150 (or other component moving therewith) are arranged to pass by a sensing board similar to the example shown in FIG. 9. In this way, an area like the area 132 (FIG. 9) can be used to detect the motion of the swing. The same sensing board may then also be used to detect the presence (or proximity) of a caregiver's finger interacting with a touch-sensitive user interface disposed on an exterior panel 154 of the housing 152. More specifically, the user interface may have a number of elements configured to simulate a traditional "button press." See, for instance, the round elements in the area 134 of the exemplary sensing board 130 of FIG. 9. Alternatively or additionally, the user interface may have a touch-sensitive area configured to detect a sliding motion. The slider element may be arranged in a circular pattern and include a capacitive "button" disposed in the center.

Figure 11:
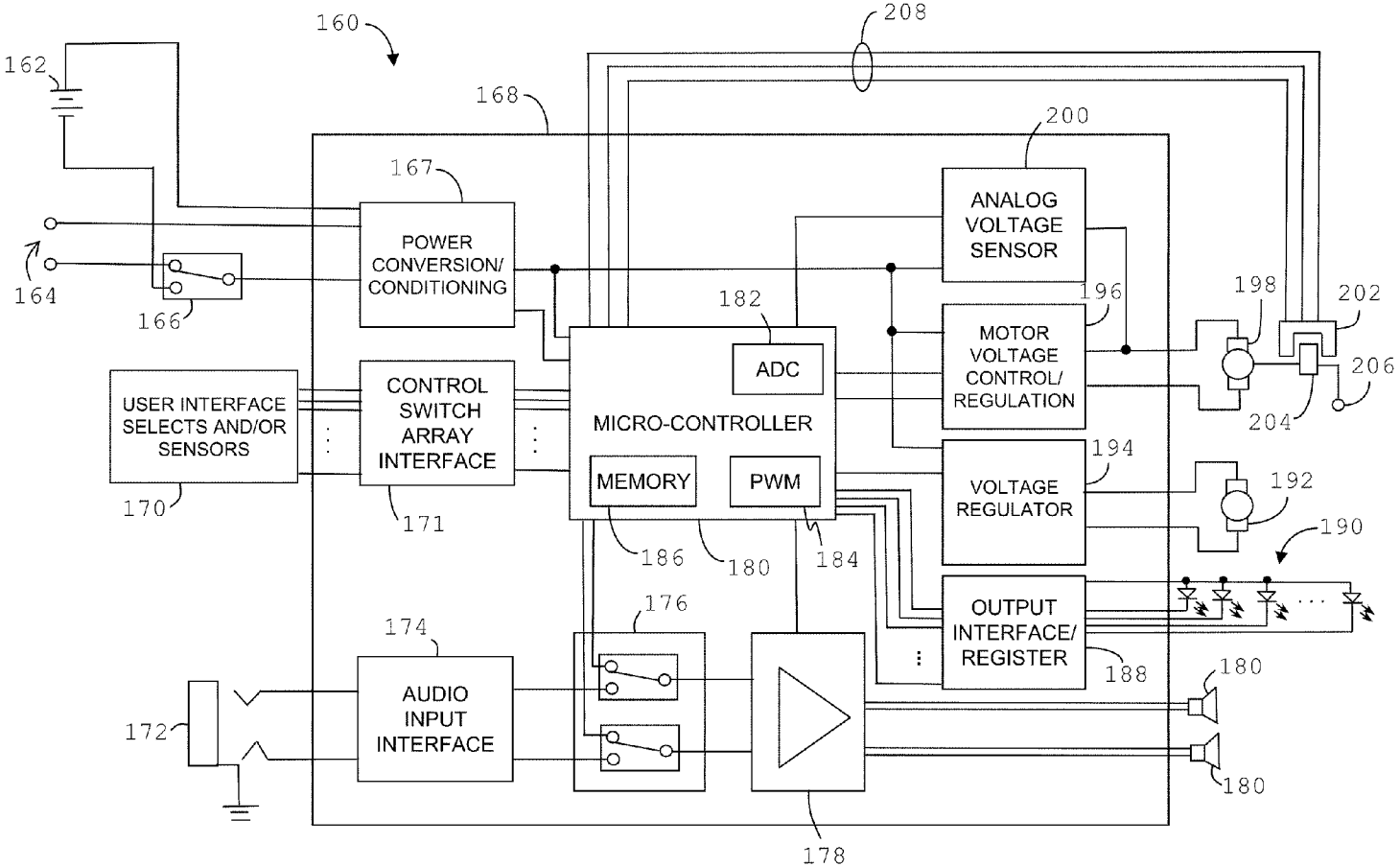
FIG. 11 is a schematic circuit diagram of a control system in accordance with various aspects of the disclosure.

FIG. 11 depicts one example of a control circuit 160 for implementing a number of control techniques and other functionality in accordance with various aspects of the disclosure, including, for instance, the motor drive feedback control techniques described above. For example, the control circuit 160 may be configured to implement a capacitive sensing scheme for motor control or, alternatively, a combination of the capacitive sensing and back EMF techniques. Generally speaking, the control circuit 160 may be configured to implement any one or more of the motor control feedback techniques identified above.

In this example, the control circuit 160 receives power from either a battery 162 or a pair of AC terminals 164. A switch 166 selects one of the two power sources, and may be driven via the absence or presence of a plug or other interface in the AC terminals 164. The control circuit 160 may be responsible for distributing power to other components of the motion control device, such as input/output elements and electric motors, as described below. To this end, the control circuit 160 may include a power conversion and/or conditioning circuit 167 configured to provide one or more DC voltage levels to various components of the motion control device, including those within the control circuit 160. In some cases, the power conversion and/or conditioning circuit 167 includes or incorporates the functionality of the switch 166.

The control circuit 160 may, but need not, be disposed on a single circuit board (e.g., PCB). In some cases, any one or more of the components shown in FIG. 11 may be disposed on a separate or dedicated board. In this example, however, the control circuit 160 includes a number of components disposed on a circuit board 168. The manner in which input and output connections are made to the circuit board 168 may vary considerably, as desired.

The control circuit 160 receives a plurality of input control signals from user interface selects and/or sensors schematically shown as 170. The user interface selects in this exemplary case involve a corresponding number of binary switches to provide an array of input control signals for directing the operation of the control circuit 160. As described above, other types of user interface elements may be utilized, in which case the nature of the input control signals may vary accordingly. In some cases, the control circuit 160 may receive instructions or other control signals from sources other than a user interface such as the one described above in connection with the control tower 36 (FIG. 1). The control circuit 160 accordingly includes one or more corresponding input interfaces 171, such as the control switch array interface shown. The control circuit 160 is also configured to receive audio input signals from an audio playback device 172 (e.g., an MP3 player), which may provide left and right stereo signals on respective lines as shown to an on-board audio input interface 174. In other cases, the device 172 may also provide or receive one or more control signals to or from the control circuit 160 for the implementation of related functionality (e.g., volume or track control).

In this example, stereo audio signals are generated by the audio input interface 174 and sent to an analog switch 176 that selects between the external audio source 172 and one or more internal audio sources. The analog switch 176 may be controlled by the caregiver via a user interface select (not shown) or via a control signal generated internally either in response to, or in conjunction with, the activation or selection of a certain source of music or sounds. The output of the analog switch 176 is provided to an amplifier 178, which generates one or more output audio signals for a corresponding number of speakers 180. In the exemplary case shown in FIGS. 1-3, the child motion device 20 includes a single speaker 179 disposed near the instrumentation panel 37 on the control tower 36. A wide variety of alternative configurations involving any number of speakers disposed at different locations on the child motion device 20 may be implemented. Configurations involving more than one speaker, for instance, may be useful in connection with certain aspects of the disclosure involving the generation of audio effects in accordance with the position and motion of the seat, as described below.

The operation of both the analog switch 176 and the amplifier 178 may be controlled by a microcontroller 180 in connection with, for instance, input selection control and volume control, respectively. The microcontroller 180, in this case, is not dedicated to controlling the audio functionality of the control circuit 160, but rather is generally involved with the control of a number of functions and operations implemented or supported by the control circuit 160. More generally, any modules, components, or functions of the control circuit 160 may be integrated onto a single integrated circuit chip to any desired extent, and need not be arranged as shown in FIG. 11. In some cases, one or more additional controllers may be utilized in addition to the microcontroller 180 to address specific tasks, such as the playback of music and sounds. For these reasons, the single microcontroller 180 in the circuit diagram of FIG. 11 need not correspond with the physical integrated circuit(s) used to implement the functions and operations of the control circuit 160.

In some exemplary cases, the microcontroller 180 is a programmable system-on-a-chip commercially available from Cypress Semiconductor Corporation (www.cypress.com). In cases in which capacitive sensing is utilized either for motor control or user interface control, the Cypress chip commercially available as model number CY8C20234 may be utilized. Further details regarding the functionality of the programmable chip that supports a mixed-signal I/O array are provided below. Generally speaking, however, this microcontroller integrates the functions typically provided by a microcontroller with the functionality of a number of analog and digital components that typically surround microcontrollers. Because this controller can integrate a large number of peripheral functions, the microcontroller 180 and, more generally, the control circuit 160 are shown in simplified form in FIG. 11. For instance, the microcontroller 180 may be configured to implement analog functions, such as amplification, analog to digital conversion, digital to analog conversion, filtering, and comparators. The microcontroller 180 may also be configured to implement digital functions, such as timers, counters, and pulse width modulation (PWM). A number of these analog and digital functions may be used in the control circuit 160 to implement the motor control feedback and motor control functions, as described further below. The representation of the microcontroller 180 shown in FIG. 11 depicts some of this functionality by separately identifying an ADC module 182, a PWM module 184, and a memory 186 (e.g., flash memory), although these modules constitute only a subset of those available.

With continued reference to FIG. 11, the exemplary control circuit 160 also includes one or more output interfaces and/or registers 188 directed to driving a plurality of user interface or other visual media elements of the child motion device. In this example, the child motion device includes a set of light emitting diodes (LEDs) 190 that may, for instance, be disposed on the user interface 50 (FIG. 5). Alternative embodiments may include any number of light indicators or other visual elements to soothe the child occupant or provide information to the caregiver.

The child motion device may also include a vibration feature supported by a vibration motor 192. In some cases, the vibration motor 192 is disposed on the seat support frame 26, as shown in FIG. 1. In such cases, control of the vibration motor 192 may be addressed locally. Alternatively or additionally, the vibration motor 192 may be controlled via the control circuit 160. To that end, a control signal generated by the microcontroller 180 may be provided to a voltage regulator 194 responsible for providing power to the vibration motor 192.

Further voltage control and/or regulation is provided by a regulator 196 for an electric motor 198 directed to the principal motion of the device. The operation of the regulator 196 is also controlled by the microcontroller 180 in accordance with the control techniques described herein. Further information regarding the techniques is set forth below.

As a general matter, however, the motor control techniques described herein involve one or more feedback mechanisms.

To this end, the exemplary control circuit 160 includes an analog voltage sensor 200 in communication with the line(s) carrying the motor voltage to the motor 198. The sensor 200 may provide an indication of any voltage generated on such lines in connection with the implementation of the back-EMF technique for determining motor position information, as described above. In some cases, the analog voltage sensor 200 may be integrated with the other functions provided by the microcontroller 180. In fact, the Cypress microcontroller has a built-in analog to digital converter with voltage reference that can be used to accurately measure the actual motor voltage and current.

Further feedback regarding motor position information (and, more generally, device motion) may be provided to the microcontroller 180 by a sensor 202 in communication with, for instance, an element 204 of the drive system, support arm, occupant seat, etc., which is schematically depicted at 206. A number of feedback lines 208 may carry the signals indicative of the position information back to the microcontroller 180. For instance, in a capacitive sensing technique, each of the analog signals developed in the traces on the sensing board may be provided by a separate line to the microcontroller 180. In some cases, the feedback lines 208 may be substantially or entirely disposed on the board 168 to avoid, for instance, problems caused by noise or parasitic capacitance. In one example, the board 168 corresponds with the sensing board carrying the traces.

The implementation of the motor control techniques is now described in greater detail. Generally speaking, the microcontroller 180 utilizes one of the sensing techniques to detect or determine the position of the rotor. In some cases, the technique may involve the use of the back-EMF generated voltage either alone or in conjunction with one of the other sensing techniques, such as capacitive sensing. Based on the position information, the microcontroller 180 generates the motor control voltage in a manner that the resulting force drives or assists revolution in the rotor in the desired direction and in an otherwise efficient manner. Motor rotation stability is accordingly improved.

The position information determined by the microcontroller 180 may also be utilized to control the motor control voltage in ways other than the timing of the application thereof. For instance, the motor position information may be used to determine the shaft speed of the motor. The shaft speed may, in turn, be used to detect or determine increases or decreases in motor load. Such changes may occur naturally due to the pendulum motion of the device, or as a result of a change in occupant weight. The microcontroller 180 may then adjust the amplitude of the motor voltage accordingly to maintain a desired swing speed or swing angle. To this end, a set point representative of the desired swing angle may be used in connection with the information regarding the motor loading (e.g., change in shaft speed and motor current) by the microcontroller 180 to alter the applied motor voltage. Such adjustments may be implemented in addition to any involved with the microcontroller 180 applying voltage according to the swing motion profile so as to optimize power delivered to the motor to thereby reduce the overall electrical power requirements.

Figure 12:
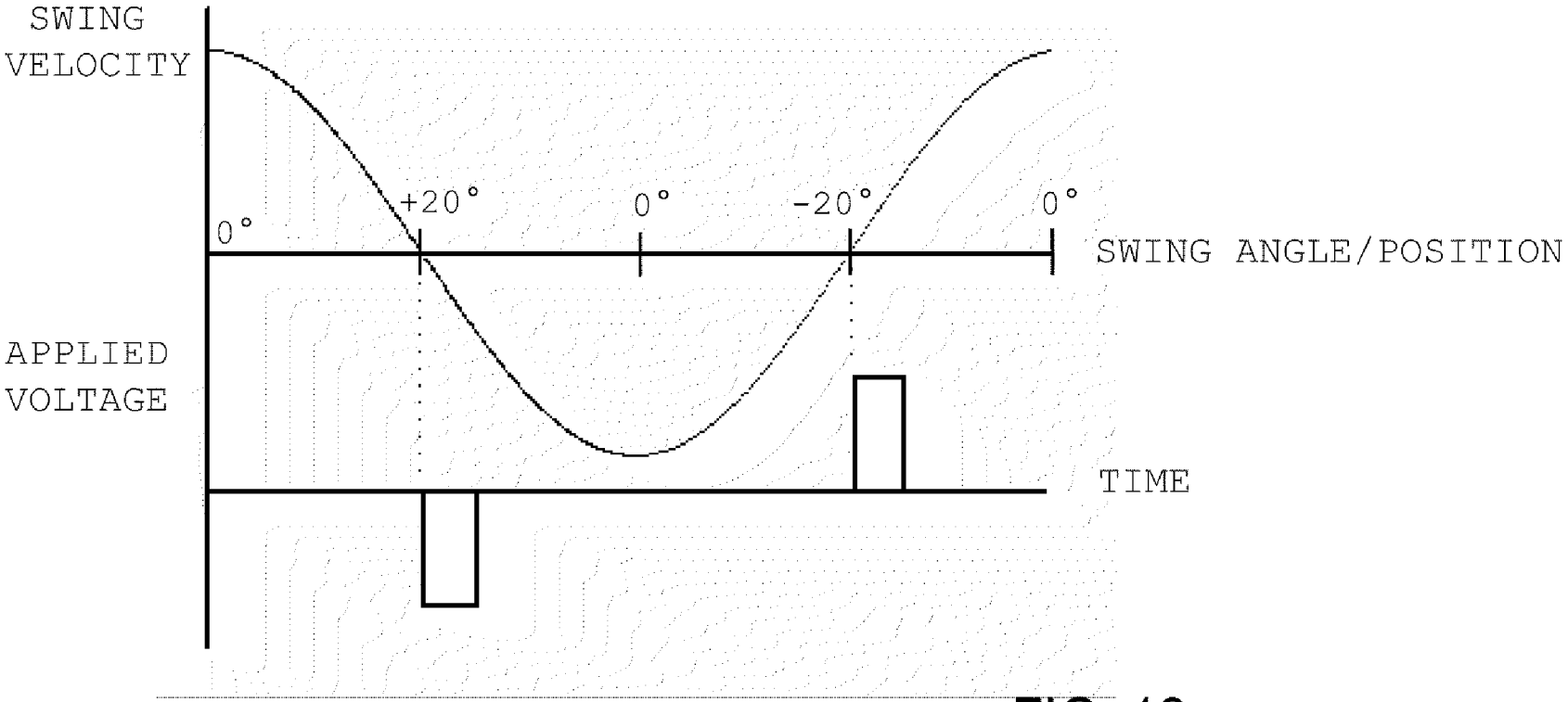
FIG. 12 depicts a simplified representation of an applied motor voltage that may be generated by the control system of FIG. 11 in accordance with one aspect of the disclosure.

FIG. 12 depicts a simplified representation of a motor control scheme in accordance with one aspect of the disclosure via a plot of the applied motor voltage. The motor voltage control scheme shown may be supported by any one or more of the motor control feedback techniques identified above. Regardless of which feedback technique is utilized, power is generally applied intermittently to the motor at strategic points in the motion cycle or path. The points are based on the position or angle of the swing, as described above. In this example, a voltage pulse is applied at a time immediately or shortly after the end of a stroke, which occurs at the maximum displacement of the swing (e.g., a swing angle of +20 or −20 degrees). This timing may also be considered to be the start of the next stroke.

The length of the voltage pulse may vary based on operating conditions and other aspects of the motor control scheme. In some cases, the application of power may be discontinued by about mid-stroke, regardless of when the power is first applied. More generally, the efficiency of the motor drive is improved via both the timing and duration of this selected application of power to the motor.

The representation of each voltage pulse in FIG. 12 may, in fact, correspond with (i.e., be composed of) a number of pulses. In many cases, the applied motor voltage involves a pulse width modulated (PWM) signal that may be internally generated by the microcontroller 180. With the position (or angle) measurement, motor voltage and current measurements, the Cypress microcontroller may be configured to generate a traditional PWM output signal, which, when passed through a power transistor (not shown) in the regulator 196 (FIG. 11), can be used to regulate the voltage applied to the motor (and thus the swing angle). More generally, the PWM output may involve the modulation of any one or more of the motor voltage amplitude, frequency, and duty cycle.

While some modules of the microcontroller 180 may be implemented separately, the PWM generator 184 may provide an option to generate a dithered, or pseudorandom, PWM output signal, which effectively varies the frequency and duty cycle of the output to minimize electromagnetic propagation of noise, thereby assisting in compliance with EMI regulations. More specifically, the "dithered" PWM output has the advantage of spreading the harmonic EMI noise generated by the PWM waveform across a wide frequency spectrum. As a result, it is possible to reduce peak values of the electrical noise to levels within the limits of various regulatory requirements.

Figure 13:
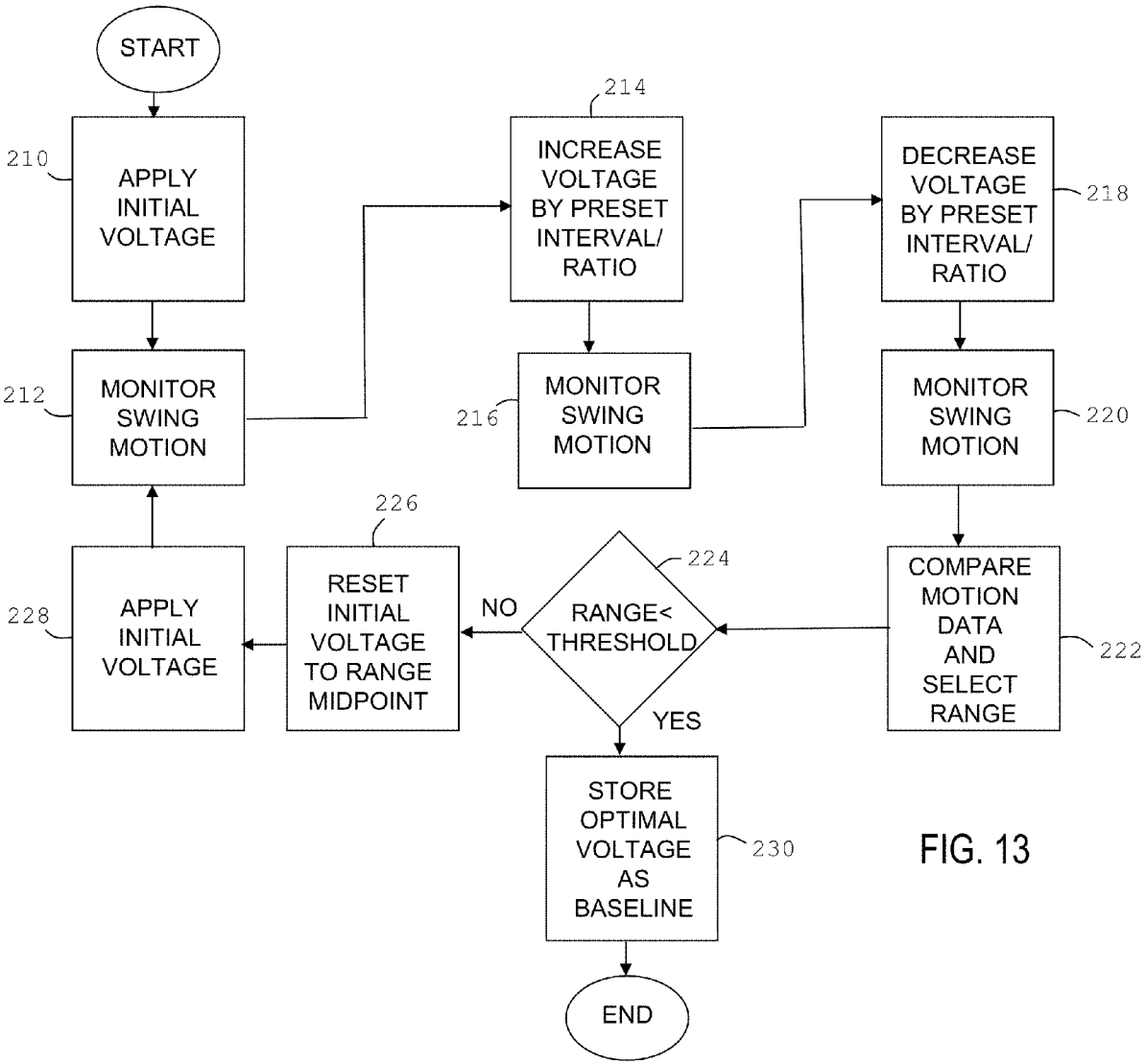
FIG. 13 is a flow diagram of a motor voltage calibration technique that may be implemented by the control system of FIG. 11 in accordance with one aspect of the disclosure.

FIG. 13 is directed to a technique for determining an optimal motor voltage amplitude in accordance with another aspect of the disclosure. Generally speaking, optimization of the motor voltage can reduce the amount of time required to start swing motion and/or achieve the desired swing angle. The need to vary or adjust the motor voltage(s) may arise from variations in the component tolerances, variations in the assembly process (manufacturing tolerances), normal "wear and tear" during operation, occupant differences (e.g., weight, center of gravity), or different device features or use conditions (e.g., the addition of a canopy or blanket). These and other factors can change the optimal starting voltage (i.e., motion from a rest position), as well as the optimal voltages applied during operation to maintain a certain swing speed.

The technique may be implemented by the functionality described above in connection with the control circuit 160 and, more specifically, the microcontroller 180. The motor voltage optimized by the technique may be associated with a starting, or self-start, voltage, or any one of a number of in-use, or operating, voltages associated with a device speed setting. In this manner, the control circuit 160 may determine in automated fashion the respective optimal motor voltages for a number of available swing speeds (e.g., speeds 1-6). The optimization of the motor voltage(s) may be considered a tuning or calibration routine, in the sense that the child motion device may be adjusted, or calibrated, for improved operation, or for differing operating conditions. The tuning, calibration or adjustments may occur on a regular or periodic basis, or after a sensed event, such as a decrease in efficiency or an inability to maintain a desired speed. To that end, implementation of the routine may occur during normal use conditions.

In one example, the calibration technique generally involves automatically adjusting the motor voltage based upon feedback information and/or measurements of motor current, motor shaft speed, and/or the measured swing angle. More specifically, the calibration routine may begin with the application of an initial, nominal voltage in a block 210. If, for example, the self start voltage is being calibrated, the initial voltage may fall in the range from about 2.5 to about 2.7 Volts. The control circuit 160 captures data and information indicative of the swing motion resulting from the applied voltage so that the microcontroller 180 can monitor the swing motion in a block 212. The monitoring step may last for a predetermined duration, after which control passes to a block 214 where the voltage to be applied is increased by a preset interval or ratio. The control circuit 160 again captures and monitors data and information indicative of the resulting swing motion in a block 216 before decreasing the applied voltage from the initial voltage by the same or similar preset interval or ratio in a block 218. After the swing motion is monitored in a block 220, the microcontroller 180 compares the motion data captured for the three applied voltages to determine in a block 222 which of the two ranges (i.e., above or below the initial voltage) is preferred for reaching the desired swing speed or motion. The preferred range is then selected by the microcontroller 180.

Control than passes to a decision lock 224 that causes the microcontroller 180 to determine whether the size of the selected range is smaller than a predetermined threshold (e.g. 0.025 V). If not, the initial voltage is reset in a block 226 for another round of monitoring to the midpoint of the selected range. The new initial voltage is then applied in a block 228 and the monitoring loop is implemented again. A new interval for defining the ranges may then be determined in a variety of ways. In one example, the size of the interval is equal to one-half of the range selected in the previous iteration. More generally, because the preset interval or ratio may be decreased (or narrowed) with each iteration of the loop (e.g., in the block 226), the selected range evaluated in the block 224 is eventually smaller than the threshold, such that control passes to a block 230 in which the midpoint of the selected range may be stored as an optimal voltage for the use condition being calibrated (e.g., speed level no. 5). The optimal voltage may also be stored as a new baseline, or starting point, for subsequent calibration procedures.

In one example, the determination made by the microcontroller 180 in the block 222 may generally involve a comparison of relative overshooting or undershooting of a swing angle. In this way, the determination may involve a calculation of the offset from a desired angle, which may be predetermined as a desired angle for a certain swing speed or a certain elapsed time after startup.

In some cases, the voltage calibration technique may be repeated multiple times (e.g., over several cycles) to determine an averaged optimal voltage. This repetitive approach may be useful in connection with determining the starting, or self-start voltages. In any case, over time, the averaged optimal voltage may be determined as a rolling average.

In accordance with another aspect of the disclosure, the above-described capacitive sensing techniques may be implemented in conjunction with control functionality to manage or regulate the operation thereof. Generally speaking, the microcontroller 180 may evaluate the sensed capacitance changes on the traces associated with a user interface to control whether a "touch" or other action should be recognized. To this end, the microcontroller 180 accesses a sensing threshold and/or routine generally directed to determining whether a change in capacitance was appropriately detected. In many cases, the threshold and routine (e.g., a comparator or set of comparisons) is utilized to avoid false positives. However, in this aspect of the disclosure, the threshold comparison may be used to predetermine or otherwise control which deliberate "touches" or other human interaction with the user interface should be recognized.

In this aspect of the disclosure, the microcontroller 180 is configured to distinguish between the different capacitance changes resulting from different caregivers or users of the motion control device. The distinction is directed to controlling or limiting interaction with the user interface, which ultimately may help avoid, resist, or prevent unintended operation of the device.

As user interface capacitive sensing measures the human body capacitance typically provided by a human finger, it is also possible to set acceptable ranges for this measurement such that the difference between an adult finger and a child finger can be determined and/or utilized. In short, child fingers have a relatively smaller capacitance and, thus, present a smaller capacitance change effect. Although finger sizes vary, especially when pressed upon a button with varying force (e.g., lightly or heavily), a usable range may be determined, where an adult finger will be recognized to allow operation of the user interface to occur. However, the "button press" of a child finger will be insufficient to activate the control element. In this way, some or all of the user interface elements (and the control operations associated therewith) may be classified as intended for adult use only, i.e., child resistant. The converse may also be set up for implementation such that, for instance, certain controls can be made available solely for work with children, i.e., "adult resistant." That type of limitation on control may be useful in situations involving the transport of the device by an adult.

To these ends, the microcontroller 180 may implement a self-calibration routine to adjust the capacitive sensing system for changes that should result in adjustments to the threshold(s). Calibration may be periodic or regular, or be triggered by an event, such as a user-initiated request to initiate the routine.

In some cases, a calibration routine may be defined such that measured capacitance changes occurring with a "touch" routinely occur within a defined range of values. Calibration to a standard range allows fixed values for noise margins, which facilitates reliable operation over time. The calibration routine may be automatically executed in the event that the measured capacitance change values fall outside a pre-determined range. Such recalibration can arise from, for instance, a significant change in the power supply (batteries wearing down), environmental changes (temperature, humidity, etc.), mechanical differences occurring during production, varying device assembly, or significant "wear and tear" over time during use.

The above-described management of a capacitive-sensitive user interface may be facilitated by the implementation of a capacitive sensing customization technique in accordance with another aspect of the disclosure. Generally speaking, the thresholds for user interface capacitive sensing may be customized through a learning routine to personalize the child device for a particular family or caregiver situation. The implementation of a learning routine may adjust the preset, or factory, settings for one or more sense thresholds. In this way, the capacitance change effect of certain fingers can be expressly designated as "child" or "adult" for either blocked or permitted operation of the user interface, respectively.

In this aspect, each individual likely to attempt to interact with the user interface during subsequent use participates in a personalization or customization routine. In so doing, the user interface and, more generally, the child motion device, is personalized via the storage of exemplary measurements of the capacitance change for each individual. To this end, the microcontroller 180 may store a set of user profiles for comparison and/or matching during subsequent operations. Alternatively or additionally, the microcontroller 180 may collect data for each member of the set of authorized operators and collect data for each member of the set of unauthorized individuals, and determine a threshold that best differentiates the two sets.

In some cases, the initiation of the learning routine may be a user-selected option. Although in other cases, the learning routine may be initiated automatically as part of a pre-configured setup procedure. In that way, the device is customized or personalized shortly after assembly and before operational use.

Figure 14:
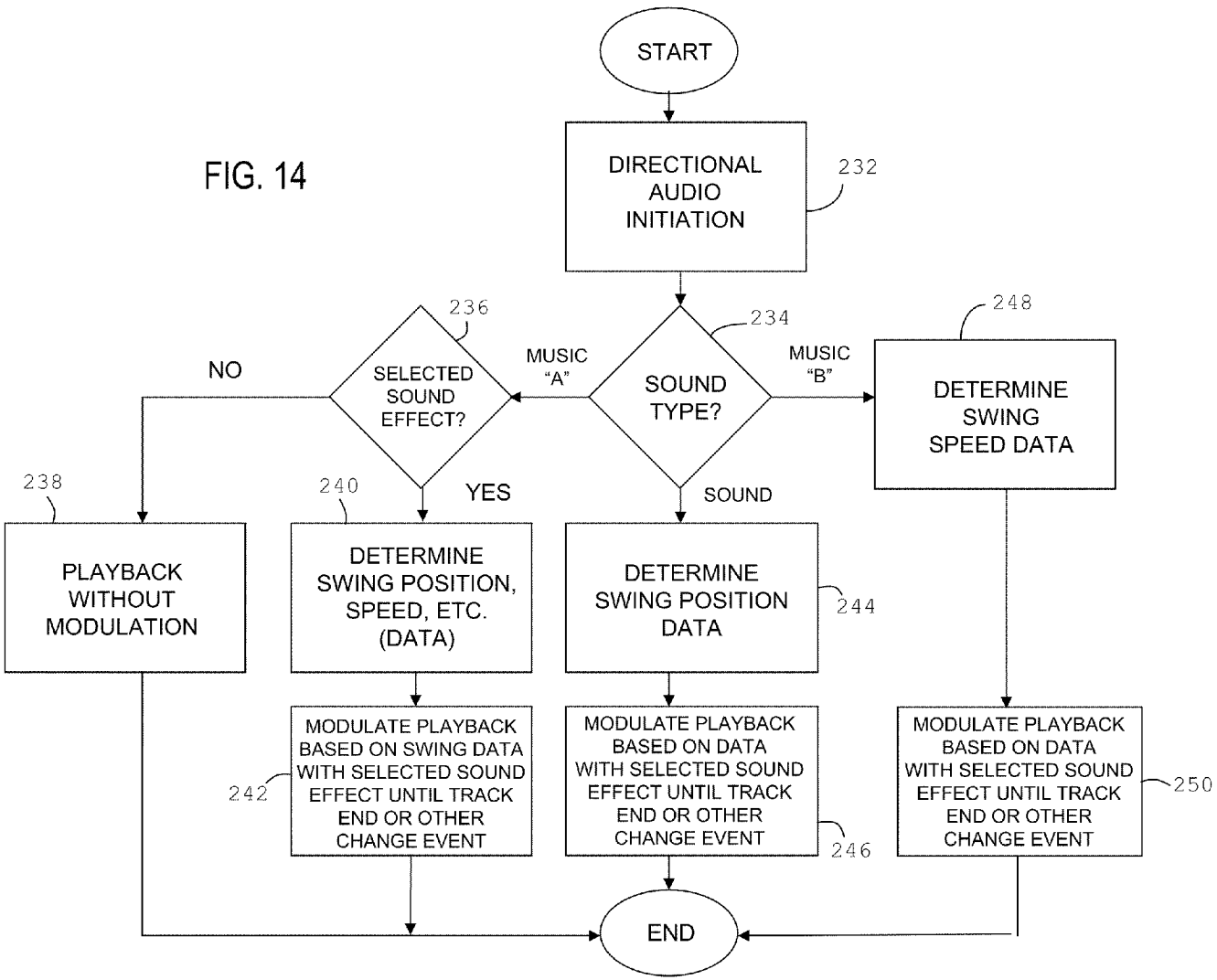
FIG. 14 is a flow diagram of an audio control technique that may be implemented by the control system of FIG. 11 in accordance with one aspect of the disclosure.

FIG. 14 is directed to another aspect of the disclosure involving implementation of one or more routines by the microcontroller 180. In this aspect, the audio output of the child motion device is generally modulated or otherwise controlled in accordance with the motion of the swing. In some cases, the audio output is modulated or controlled based on the current position or angle of the swing. Alternatively or additionally, the audio output is modulated or controlled based on the current swing speed.

As described above, the motion control device may include any number of speakers (mono, stereo, surround sound, etc.) in a variety of speaker positions. Many, if not all, of the speaker positions will be in relative motion with respect to the seat occupant during swing motion. Such relative motion may create desirable or undesirable effects that are either intended or unintended. Nonetheless, with the real-time swing data captured using the feedback techniques described above, knowledge of the position, speed and direction of the swing is available in real-time, and can be used to provide new and innovative child soothing sound effects that correlate to the position of the swing. In this way, the playback of music and sounds may be coordinated with a selected or predetermined sound effect that modulates the playback based on the specific position, speed, or direction of the seat during normal swing motion or operation. In one example, the audio may be modulated to present a directional effect to the seat occupant. As a result, the sound effect can 'track' along with the motion of the swing motion. In another example, the swishing sound of blood flow that an infant may recognize from inside the womb can be reproduced to sound as if the flow is occurring around the baby in a more accurate manner. With a more accurate reproduction, it is more likely that the soothing womb experience can be replicated by the child motion device.

A variety of different modulation schemes may be utilized in connection with this aspect of the disclosure. An exemplary list may include volume adjustments, balance adjustments, warping of sound, an ocean affect, various pitch changes, and an enhanced Doppler effect.

In the exemplary flow of FIG. 14, initiation of directional audio modulation (or other swing motion-based playback modulation) occurs in a block 232 via, for instance, actuation of a user select. A decision block 234 may determine the type of sound currently selected for playback. In this example, there are three different types of sound or music available for playback. In other embodiments, any number of categories or types of sound or music may be available, such that the decision block 234 may direct the flow of control in any number of paths. In this case, music type "A" may correspond with stereo or fast music, while music type "B" may correspond with mono or slow music. The distinction between music types may limit or drive the types of sound effects suitable for playback modulation. For instance, stereo or mono music may utilize certain speakers either well suited or ill-suited for certain types of playback modulation. The last exemplary music type or category, sound, may also be well suited for types of playback modulation not readily applicable to music playback, thereby justifying a separate routine flow.

With music type "A" to be played back, control passes to another decision block 236 in which the controller 180 determines whether a particular sound effect has been selected by the caregiver via, for instance, the user interface 50. If not, music type "A" may generally be ill-suited for playback modulation. Accordingly, control passes to a block 238 that directs the controller 180 to playback the music without modulation.

If a sound effect has been selected, control passes to a block 240 where the controller 180 proceeds to determine swing position, speed and/or other data to support the playback modulation in real-time. Eventually, playback of the music is modulated in a block 242 based on the swing data in accordance with the selected sound effect until the end of the track or the occurrence of some other status changing event, such as a time-out.

With the sound option to be played back, control passes to a block 244 that determines the swing data to support the playback modulation. In this case, the modulation is based on swing position rather than on some other combination of swing data, and the sound has a predetermined modulation effect associated therewith. Playback of the music is then implemented in a block 246 based on the swing position data with the predetermined modulation effect (e.g., warping of sound) associated with that sound.

Lastly, the playback of music type "B" provides another possible option for a directional audio techniques. In this exemplary case, the controller 180 determines in a block 248 the current swing speed and utilizes that data alone to modulate the playback of the music. Again, music playback is implemented in a block 250 based on the swing speed data with a selected or predetermined modulation effect until the end of the track or the occurrence of some other status changing event.

The foregoing routine is provided with the understanding that it is entirely exemplary in nature. More generally, practice of the disclosed directional audio technique may involve a wide variety of sound or music profiles, with any one or more particular swing motion data variables relevant thereto, a wide set of different modulation effects, and a host of other preferences or criteria for playback. The number of possible permutations of the combinations of these and other options is accordingly very expansive and extensive. Various combinations of these factors may be stored in the microcontroller 180, and may be created by an operator and/or predetermined as factory settings.

Alternatively or additionally, the playback modulation of music or sound may involve or include multiple tracks in combination. For example, one track may be reproduced through a first speaker (with any desired modulation effects), while a different track with a different modulation effect may be reproduced through a second speaker. Thus, practice of the disclosed technique is not limited to any one sound effect or playback scheme at any one point in time.

More generally, implementation of the above-described directional audio technique is based on real-time knowledge of the swing motion. Because the above-described position and other data capturing techniques can provide such real-time data with improved accuracy, and in absolute rather than relative terms, certain audio effects can be achieved that may be otherwise unavailable.

Figure 15:
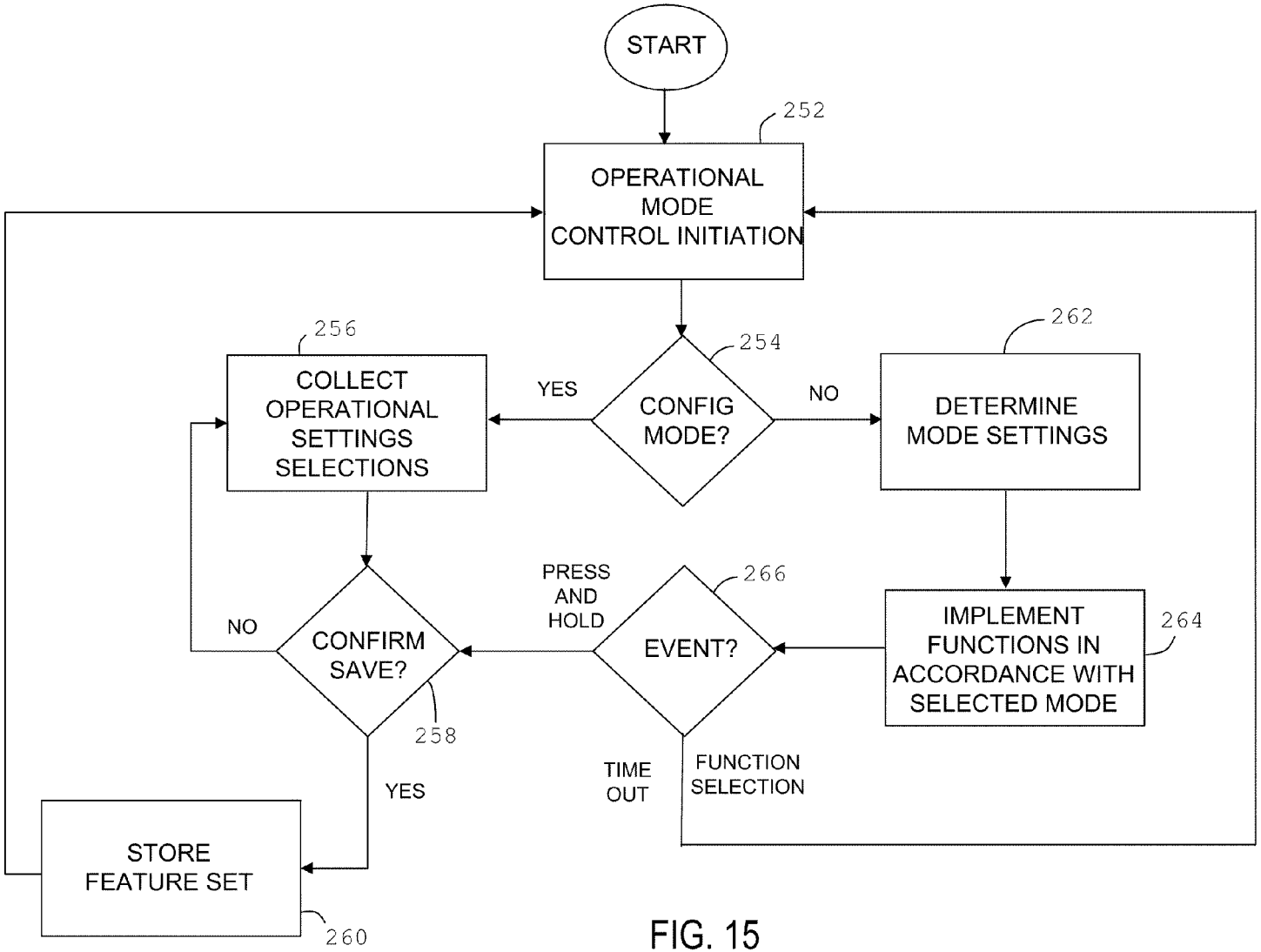
FIG. 15 is a flow diagram of an operational mode control technique that may be implemented by the control system of FIG. 11 in accordance with one aspect of the disclosure.

Yet another aspect of the disclosure for implementation by the microcontroller 180 is described and shown in connection with FIG. 15. In this aspect, the functionality of a motion control device is collectively managed or controlled in accordance with one or more operational modes. Each operational mode can define any number of operational or functional settings (e.g., a programmed feature set) that may, but need not, specify each available operation or function. Exemplary operations and functions that may be controlled collectively include, for instance, audio input source, audio volume, playback speed, playback type or selection, audio directional balance, vibration motor activation, vibration motor intensity, swing speed, lighting options, imagery projection and other visual effects, changes in speed for additional objects such as mobiles or other toys, and other toy functions remotely mounted on the product. These toys/soothing features may wirelessly communicate to the main swing control unit, via an operator's remote control unit through a two way radio, or via an infrared connection. The operational mode may associate such operations or functions for either sequential or simultaneous operation.

Any number of operational modes may be preprogrammed or predetermined as, for instance, factory settings. More generally, the microcontroller 180 may be configured to provide a user with an opportunity to create and store user-defined modes or feature sets. The opportunity may be initiated in a variety of manners, including, for instance, holding down buttons or pressing a series of buttons provided via a user interface.

It may be desirable to create modes of operation for the swing to help soothe or actively engage the child in some entertaining or educational manner. These modes may link various functions of the swing together into pre-defined or user defined applications that would better soothe a child by providing them with a set (or all) aspects of appropriate or otherwise related stimuli tailored to the child's situation. In some cases, these related functions may include swing speed, music, nature/womb sound playback selection, volume, vibration functions, lighting, motion or changes of speed. Similarly, a plurality of amplitudes of each of the items mentioned above may be combined in a variety of ways to creates moods such as "sleepy time," wake-up time, play time, etc.

In one example, the implementation of the operational mode control aspect of the disclosure involves the routine shown in FIG. 15. A user may initiate the routine via actuation of a user interface select or other element, after which the microcontroller 180 may in a block 252 access a default mode, the last-used mode, and/or prompt the operator for further information. In this case, the microcontroller 180 determines in a decision block 254 whether the operator intends to select a predefined operational mode (i.e., a mode available for selection, whether user-defined or factory set) or define a new operational mode. The available modes may be stored in association with a number or other designation that may be selected by the operator. A separate number or designation may also be available for the operator to select a configuration option for defining a new operational mode. If the operator selects the configuration option, control passes to a block 256 in which the microcontroller 180 selects and aggregates any number of operational settings and/or selections. The user interface may facilitate the selection process in a variety of ways. The operator may then select, or be prompted, to store the settings and/or selections in connection with a decision block 258. If accepted, a storage operation is implemented in a block 260, and control eventually passes back to the block 252 where the settings and/or selections are made available as a feature set. If not, control may return back to the block 256 for further data collection.

When the operator has not elected to configure the operational mode control aspects of the device, control passes to a block 262 in which the operational settings or selections defined by, or associated with, a selected operational mode are determined. Then the microcontroller 180 may proceed in a block 264 with the implementation of the functions or operations in accordance with the selected operational mode and, specifically, the operational settings or selections defined thereby.

In some cases, the routine may provide an opportunity for an operator to interrupt an operational mode without having to, for instance, deactivate the entire device. If, at some point during the implementation of the associated functions, the microcontroller 180 detects a status changing event, then a decision block 266 determines whether to pass control to those blocks involved in configuring the operational mode control. This decision may, for instance, turn on the manner in which a user interface select is actuated. A press-and-hold, for instance, may result in re-configuration of the current operational mode, such that control passes to the block 258 to proceed with storing the change. Other button presses may direct the microcontroller 180 to discontinue the operational mode control and return the control to the user prompt provided via the block 252. A time-out or other end to the operational mode may also return control to the user prompt.

References to the storage of data or information in connection with the implementation of any of the above-described techniques shall be understood to include the recordation of the data or information in any type of memory device or medium accessible by the motion control device. Accordingly, references to memory, storage, etc. may, but need not, involve the memory 186 of the microcontroller 180. Thus, the motion control devices and techniques described herein may include or involve one or more memories or storage media either integrated or discrete from the circuit elements described above.

The term swing is used herein to refer to any child motion device that has a repetitive, reciprocating, and/or generally pendulum-based motion.

Embodiments of the disclosed systems, devices, routines, techniques, and methods described above may be stored and/or implemented via hardware, firmware, software, or any combination thereof. Some embodiments may be implemented as computer programs executing on programmable systems comprising at least one processor, a data storage system (including volatile and non-volatile memory and/or storage elements), at least one input device, and at least one output device. Program code may be applied to input data to perform the functions described herein and generate output information. The output information may be applied to one or more output devices, in known fashion.

The programs may be implemented in a high level procedural or object oriented programming language to communicate with any type of processing system. The programs may also be implemented in assembly or machine language, if desired. In fact, practice of the disclosed systems, devices, routines, techniques, and methods is not limited to any particular programming language. In any case, the language may be a compiled or interpreted language.

The programs may be stored on a storage media or device (e.g., floppy disk drive, read only memory (ROM), CD-ROM device, flash memory device, digital versatile disk (DVD), or other storage device) readable by a general or special purpose programmable processing system, for configuring and operating the processing system when the storage media or device is read by the processing system to perform the procedures described herein. Embodiments of the disclosed systems, devices, routines, techniques, and methods may also be considered to be implemented as a machine-readable storage medium, configured for use with a processing system, where the storage medium so configured causes the processing system to operate in a specific and predefined manner to perform the functions described herein.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

The foregoing description is given for clearness of understanding only, and no unnecessary limitations should be understood therefrom, as modifications within the scope of the invention may be apparent to those having ordinary skill in the art.

Although certain systems, devices, routines, techniques, and methods have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A method of controlling a child motion device having a speaker, a frame, and a child occupant seat supported by the frame, comprising:

driving the child occupant seat for movement along a path in which the child occupant seat moves relative to the speaker;

generating feedback data indicative of the movement; and creating a sound effect for an occupant of the child occupant seat that tracks along with the movement of the child occupant seat by modulating an audio output of the speaker in accordance with the feedback data.

2. A method according to claim 1, wherein the creating step comprises applying a modulation effect to an audio track available to the child motion device.

3. A method according to claim 2, wherein the modulation effect involves pitch changes.

4. A method according to claim 2, wherein the modulation effect is user-selected.

5. A method according to claim 2, wherein the modulation effect is predetermined and associated with a type of audio to be reproduced by the child motion device.

6. A method according to claim 5, wherein the type of audio involves stereo playback.

7. A method according to claim 6, wherein the modulation effect involves balance adjustments between the speaker and a further speaker of the child motion device.

8. A method according to claim 1, wherein the feedback data is indicative of current position along the path such that the audio output is controlled in real-time based on the current position.

9. A method according to claim 8, wherein the generating step comprises implementing a sensing routine involving detection of capacitance changes in a capacitive sensor array resulting from the movement.

10. A method according to claim 1, wherein the feedback data is indicative of current position along the path and current direction of the movement.

11. A method according to claim 1, wherein the movement along the path is reciprocating movement.

12. A method according to claim 1, wherein the audio output comprises playback of a plurality of tracks.

13. A method according to claim 12, further comprising directing first and second tracks of the plurality of tracks to the speaker and a further speaker of the child motion device, respectively.

14. A child motion device comprising:

a frame;

a speaker coupled to the frame;

a child occupant seat supported by the frame;

a drive system coupled to the frame to produce movement along a path in which the child occupant seat moves relative to the speaker;

a sensor responsive to the movement to generate feedback data indicative of the movement; and, a controller coupled to the sensor to create a sound effect for an occupant of the child occupant seat that tracks along with the movement of the child occupant seat via modulation of an audio output of the speaker in accordance with the feedback data.

15. A child motion device according to claim 14, wherein the controller is configured to modulate the audio output via pitch changes.

16. A child motion device according to claim 14, wherein the feedback data is indicative of current position along the path, and wherein the controller is configured to modulate the audio output in real-time based on the current position.

17. A child motion device according to claim 14, wherein the feedback data is indicative of current position along the path and current direction of the movement.

18. A child motion device comprising:

a frame;

a speaker coupled to the frame;

a child occupant seat supported by the frame;

a drive system coupled to the frame to produce reciprocating movement along a path in which the child occupant seat moves relative to the speaker;

a sensor responsive to the reciprocating movement to generate feedback data indicative of the reciprocating movement; and, a controller coupled to the sensor to create a sound effect for an occupant of the child occupant seat that tracks along with the movement of the child occupant seat via modulation of an audio output of the speaker in accordance with the feedback data.

19. A child motion device according to claim 18, wherein the controller is configured to modulate the audio output via pitch changes.

20. A child motion device according to claim 18, wherein the feedback data is indicative of current position along the path, and wherein the controller is configured to modulate the audio output in real-time based on the current position.

21. A child motion device according to claim 18, wherein the feedback data is indicative of current position along the path and current direction of the reciprocating movement.

* * * * *